US009556666B1

(12) United States Patent
Buchanan

(10) Patent No.: US 9,556,666 B1
(45) Date of Patent: Jan. 31, 2017

(54) AUTOMATIC ADJUSTABLE NOZZLE SYSTEMS

(71) Applicant: Cardinal IG Company, Eden Prairie, MN (US)

(72) Inventor: Robert C. Buchanan, Spring Green, WI (US)

(73) Assignee: Cardinal IG Company, Eden Prairie, MN (US)

( * ) Notice: Subject to any disclaimer, the term of this patent is extended or adjusted under 35 U.S.C. 154(b) by 0 days.

(21) Appl. No.: 14/844,787

(22) Filed: Sep. 3, 2015

(51) Int. Cl.
*E06B 3/66* (2006.01)
*E06B 3/673* (2006.01)
*E06B 3/663* (2006.01)

(52) U.S. Cl.
CPC ..... *E06B 3/6733* (2013.01); *E06B 3/6612* (2013.01); *E06B 3/66304* (2013.01); *E06B 3/67391* (2013.01)

(58) Field of Classification Search
CPC ..... B32B 17/10036; E06B 3/6612; E06B 3/66304; E06B 3/6733; E06B 3/67391; E06B 2003/226; Y02B 80/24
USPC ..... 156/99, 106, 107, 109
See application file for complete search history.

(56) References Cited

U.S. PATENT DOCUMENTS 5,762,738 A * 6/1998 Lafond ..... E06B 3/67343 156/107
5,806,272 A 9/1998 Lafond
6,606,837 B2 8/2003 Trpkovski et al.
6,665,995 B2 12/2003 Deane
6,793,971 B2 9/2004 Trpkovski
7,429,299 B2 9/2008 McGlinchy et al.
8,435,367 B2 5/2013 Donohue
8,596,024 B2 12/2013 Trpkovski
8,776,350 B2 7/2014 Cooper
8,789,343 B2 7/2014 Zurn et al.
2003/0024180 A1 2/2003 Hartig et al.
2005/0013950 A1 1/2005 Trpkovski
2007/0175120 A1 8/2007 Lenhardt
2009/0194156 A1 8/2009 Grommesh et al.
2011/0041427 A1 2/2011 Bouesnard
2012/0180936 A1* 7/2012 Schuler ..... B29C 47/0019 156/109

FOREIGN PATENT DOCUMENTS

WO 9505349 A1 2/1995

* cited by examiner

*Primary Examiner* — George Koch
(74) *Attorney, Agent, or Firm* — Fredrikson & Byron, P.A.

(57) ABSTRACT

The invention provides a sealant applicator machine for dispensing sealant onto an insulating glazing unit. The insulating glazing unit may include two panes separated by a spacer having a spacer width. The sealant may be dispensed around a periphery of the insulating glazing unit. In certain embodiments, the sealant applicator machine includes both a fixed width sealant-dispensing head comprising a fixed width dispensing nozzle, and an adjustable sealant-dispensing head having a plurality of adjustable dispensing nozzles. The fixed width sealant-dispensing head and the adjustable sealant-dispensing head may be operably coupled to one or more sealant supplies.

30 Claims, 23 Drawing Sheets

AUTOMATIC ADJUSTABLE NOZZLE SYSTEMS

TECHNICAL FIELD

This disclosure relates to sealant applicator machines having nozzles that dispense sealant. In particular, this disclosure relates to sealant applicator machines used to manufacture insulating glazing units.

BACKGROUND

The present invention is in the field of insulating glazing unit ("IG unit") manufacturing. IG units have at least two spaced-apart, parallel panes. A peripheral spacer, typically formed of metal and/or plastic, is commonly provided between the panes adjacent their peripheral edges to maintain the panes in a spaced-apart configuration.

Conventional spacers are often provided in hollow, tubular form. In such cases, the spacer may have side walls adhered to the confronting inner pane surfaces. The spacer may extend all the way around the perimeter of the IG unit.

To seal the edges of the IG unit, one or more sealants are usually provided between the panes and the sides of the spacer. In addition, sealant is commonly applied over the outside face of the spacer. The resulting sealant arrangement provides resistance to water vapor and unwanted atmospheric gas permeating into the between-pane space(s) of the IG unit. In addition, if the between-pane space is filled with thermally insulative gas, the seal provides resistance to such gas escaping from the between-pane space. Known sealant materials include polyisobutylene (PIB), silicone, a combination of PIB and silicone, and various other materials.

The sealant beads that form the sealant arrangement may be applied by dispensing the sealant from nozzles. The resulting sealant arrangement may provide a seal around the perimeter of the IG unit. The sealant arrangement may, together with any spacer, extend from the inner surface of one pane to the inner surface of an adjacent pane. In some cases, the sealant around the perimeter of the IG unit entirely covers the outside face of the spacer, thus encapsulating the spacer between the panes.

SUMMARY

This disclosure relates to sealant applicator machines having nozzle systems that dispense sealant. In particular, this disclosure relates to an advantageous sealant applicator machine having adjustable features that can be used in manufacturing IG units. Such IG units commonly each include two panes separated by a spacer having a spacer width.

Conventional sealant applicator machines provide effective seals in IG units. However, to accommodate manufacturing IG units having different spacer widths, as may be required for made-to-order ("MTO") production, conventional sealant applicator machines require that nozzles be changed out in order to change the width of the sealant arrangement being applied. The adjustable features of the present machine are beneficial in reducing or eliminating the down-time associated with changing nozzles.

In one embodiment, the invention provides a sealant applicator machine that includes both a fixed width sealant-dispensing head and an adjustable sealant-dispensing head. The fixed width sealant-dispensing head includes a fixed width dispensing nozzle, while the adjustable sealant-dispensing head has a plurality of adjustable dispensing nozzles. One or more sealant supplies are operably coupled with the fixed width dispensing nozzle and the adjustable dispensing nozzles.

In another embodiment, the invention provides a sealant applicator machine for dispensing sealant onto an IG unit. The sealant applicator machine includes an adjustable sealant-dispensing head comprising an inner nozzle portion having a first dispensing orifice and an outer nozzle portion having a second dispensing orifice. The inner and outer nozzle portions are moveable such that a gap distance between the inner nozzle portion and the outer nozzle portion is adjustable. The sealant applicator machine further includes one or more sealant supplies operably coupled with the first and second dispensing orifices.

In still another embodiment, the invention provides a method of dispensing sealant onto a first IG unit, which includes two panes separated by a spacer having a first spacer width. The method includes providing a sealant applicator machine, which includes an adjustable sealant-dispensing head comprising an inner nozzle portion having a first dispensing orifice and an outer nozzle portion having a second dispensing orifice. In the present embodiment, the machine further includes one or more sealant metering devices operably coupled with the first and second dispensing orifices. The method includes determining a desired pane separation distance for two panes of the first IG unit, adjusting a gap distance between the inner nozzle portion and the outer nozzle portion based on the desired pane separation distance for the first IG unit, and operating the one or more sealant metering devices such that the first and second dispensing orifices dispense sealant onto the first IG unit.

In yet another embodiment, the invention provides a sealant applicator station comprising a frame, a sealant applicator machine, and a substrate transport system. The frame comprises a plurality of beams (e.g., including upright and horizontal beams). The sealant applicator machine comprises an adjustable sealant-dispensing head and a supply of sealant. The adjustable sealant-dispensing head comprises: i) an inner nozzle portion having a first dispensing orifice, and ii) an outer nozzle portion having a second dispensing orifice. The inner and outer nozzle portions are moveable selectively toward or away from each other so as to change a gap distance between the inner nozzle portion and the outer nozzle portion and thereby change a width of a sealant arrangement that the adjustable sealant-dispensing head is configured to dispense. The substrate transport system comprises a conveyor elongated along a lateral axis of the sealant applicator station.

The substrate transport system can optionally further comprise an inlet carriage and an outlet carriage. The inlet carriage can be mounted for movement along a first rail that is elongated along the lateral axis of the sealant applicator station. The outlet carriage can be mounted for movement along a second rail that is elongated along the lateral axis of the sealant applicator station. Preferably, the inlet carriage and the outlet carriage each have one or more suction cups. The first rail may extend from the conveyor to a working position of the sealant applicator station, while the second rail extends from the working position of the sealant applicator station to a downstream position.

The conveyor may have a downstream end region that is positioned adjacent to an upstream end region of the first rail such that when the conveyor moves an IG unit to the downstream end region of the conveyor, one or more suction cups on the inlet carriage can be activated and thereby secured to the IG unit. At this point, the inlet carriage, while carrying the IG unit, can move downstream along the first rail until the IG unit reaches the working position, at which point one or more suction cups on the outlet carriage can be activated and thereby secured to the IG unit, after which the one or more suction cups on the inlet carriage can be deactivated and thereby released from the IG unit. And subsequently the outlet carriage, while carrying the IG unit, can move along the second rail to the downstream position.

The details of one or more examples are set forth in the accompanying drawings and the description below. Other features, objects, and advantages will be apparent from the description and drawings, and from the claims.

DETAILED DESCRIPTION

The following detailed description is exemplary in nature and is not intended to limit the scope, applicability or configuration of the invention in any way. Rather, the following description provides practical illustrations for implementing illustrative embodiments of the invention. Examples of constructions, materials, dimensions, and manufacturing processes are provided for selected elements; all other elements employ that which is known to those of ordinary skill in the field of the invention. Those skilled in the present art will recognize that many of the noted examples have a variety of suitable alternatives.

Figure 1A:
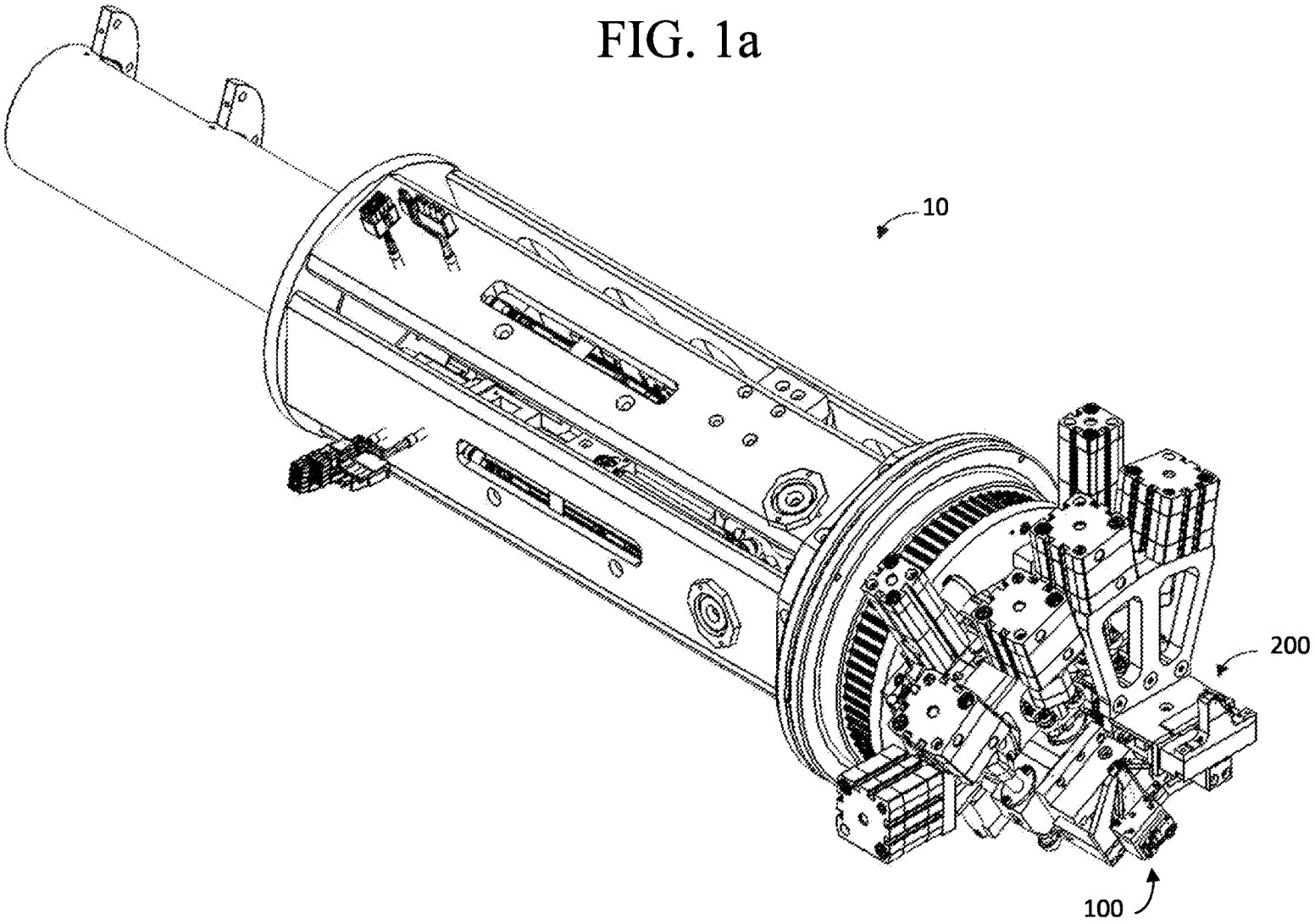
FIG. 1*a* is a perspective view of an embodiment of a sealant applicator machine including both an adjustable sealant-dispensing head and a fixed width sealant-dispensing head.
Figure 1B:
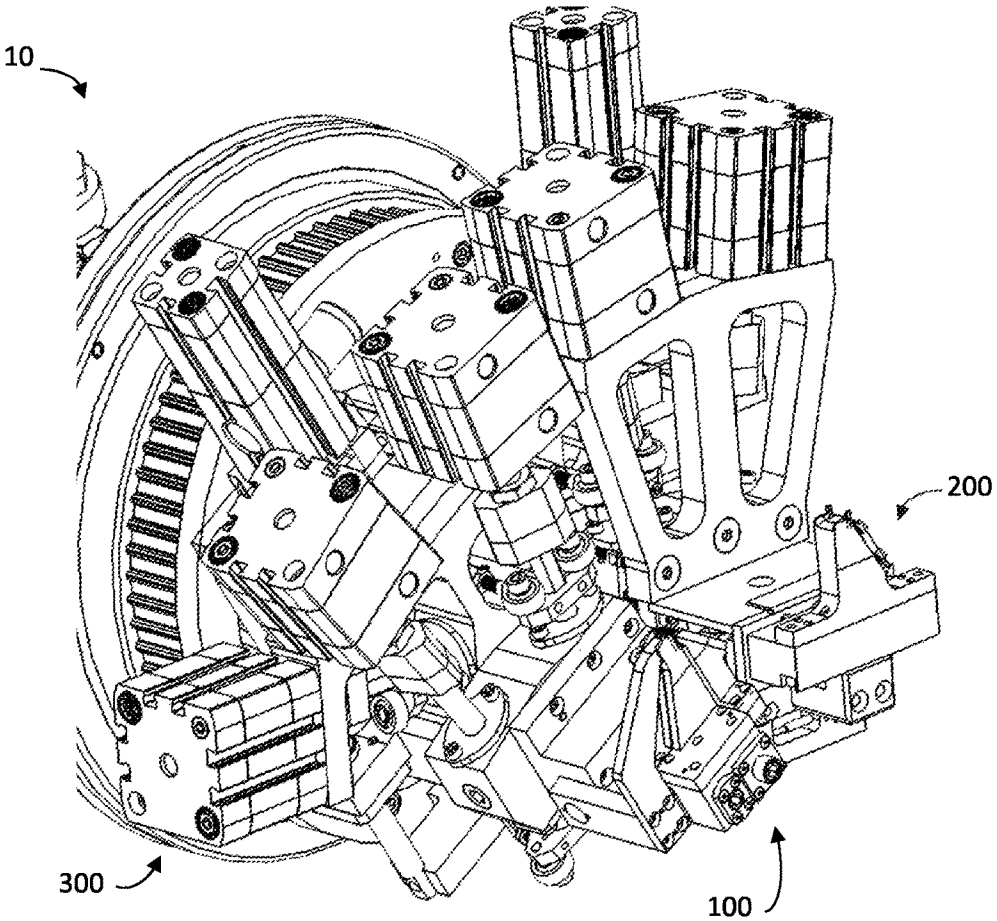
FIG. 1*b* is a close-up perspective view of a portion of the sealant applicator machine of FIG. 1*a*.
Figure 1C:
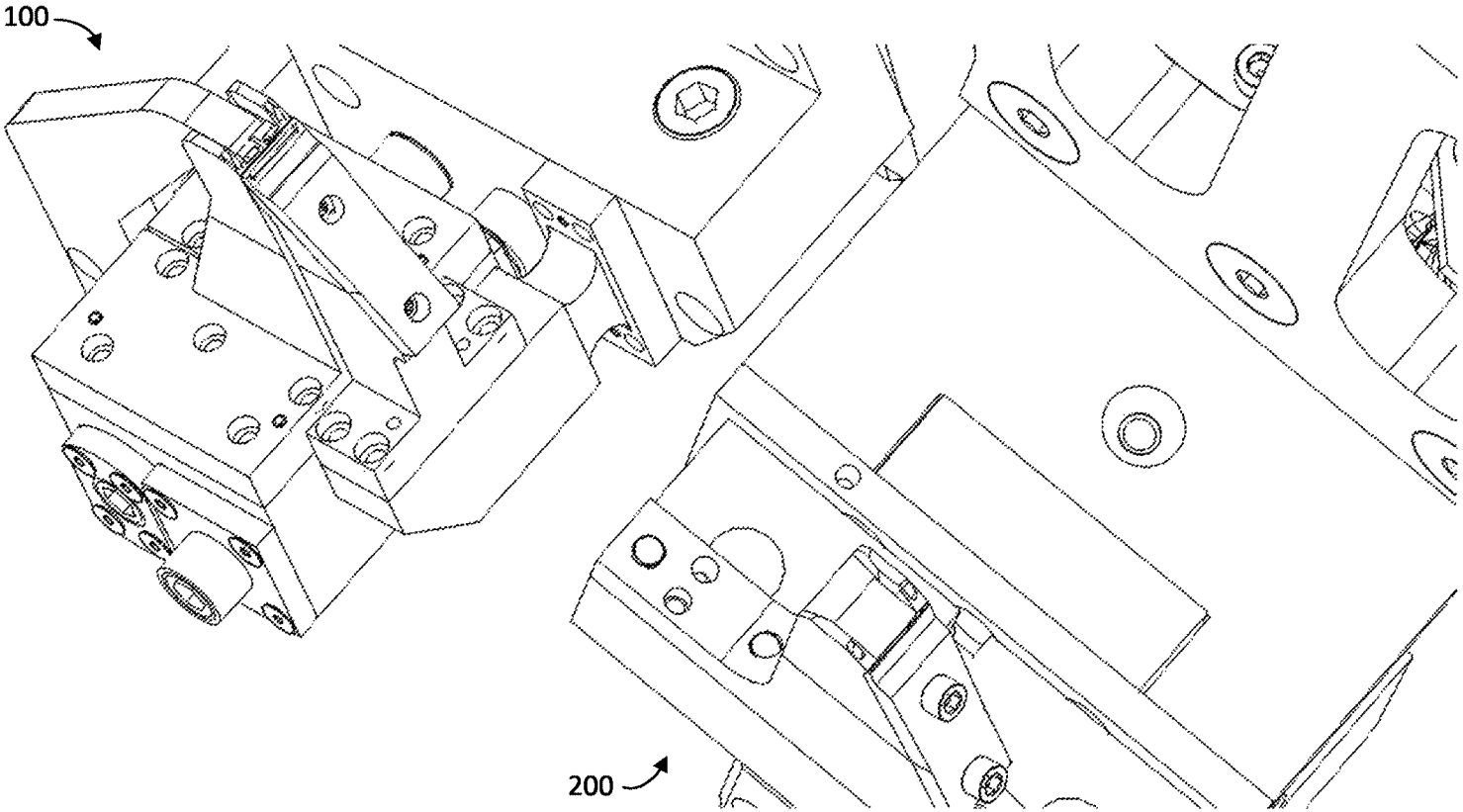
FIG. 1*c* is a close-up perspective view of the adjustable sealant-dispensing head and the fixed width sealant-dispensing head of the sealant applicator machine of FIG. 1*a*.

The invention provides a sealant applicator machine 10. One embodiment of the machine is shown in FIGS. 1*a-c*. The sealant applicator machine 10 can be used to dispense sealant onto an insulating glazing unit ("IG unit"), such as the IG unit 20 shown in FIGS. 2*d*, 2*e*, and 4*c*. The IG unit 20, 20' includes two panes 22, 24, 22', 24' held in a spaced-apart relationship, commonly by a spacer 30, 30' having a spacer width 32, 32'. The spacer 30, 30' can be joined to the panes 22, 24, 22', 24', thereby forming a between-pane space 29, 29'. The perimeter 27 (as depicted in FIG. 2*d*) of the IG unit 20, 20' may then be sealed. In FIG. 2*d*, the perimeter 27 has four sides and delineates a rectangular shape. It is to be appreciated, however, that this is by no means required; IG units of many different shapes can be used.

The between-pane space 29, 29' can optionally be provided with an insulative gas fill (e.g., a mix of argon and air)

to enhance the insulative properties of the IG unit 20, 20'. Alternatively, the between-pane space 29, 29' can simply contain air or be a vacuum.

Figure 4A:
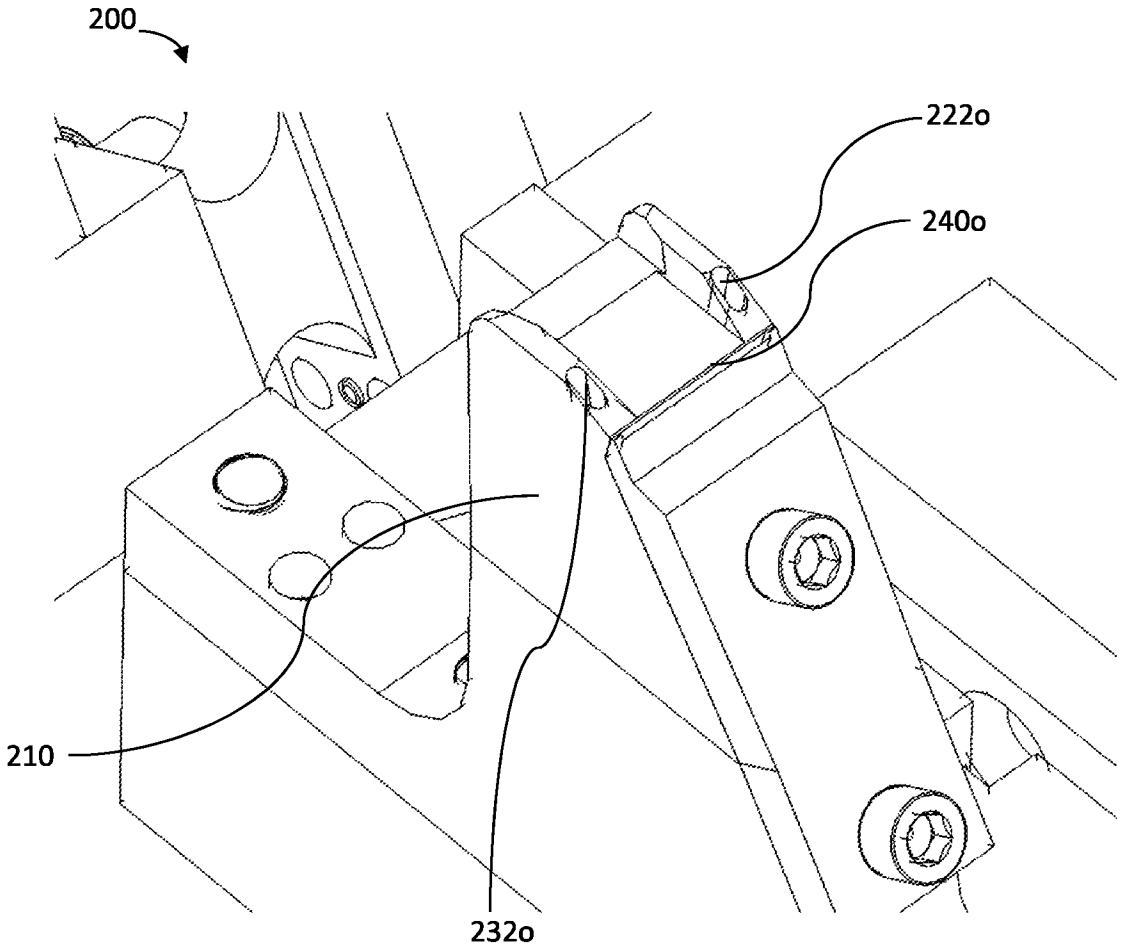
FIG. 4*a* is a close-up perspective view of the fixed width sealant-dispensing head of the sealant applicator machine of FIG. 1*a*.

The dispensed sealant can advantageously be in the form of an arrangement of multiple sealant deposits (collectively referred to herein as a "sealant arrangement"). Various sealant arrangements are discussed below in more detail. In the embodiment of FIG. 4*c*, the sealant arrangement 40' extends continuously from the inner surface of the first pane 22' to the inner surface of the second pane 24', and entirely covers the outside face of the spacer 30'.

As shown in FIG. 1*a-c*, the sealant applicator machine 10 may include both an adjustable sealant-dispensing head 100 and a fixed width sealant-dispensing head 200. In some embodiments, however, the machine includes only the adjustable sealant-dispensing head (without the fixed width sealant-dispensing head). FIG. 1*c* is a close-up perspective view of the adjustable sealant-dispensing head 100 and the fixed width sealant-dispensing head 200 of the sealant applicator machine 10. As shown in FIG. 1*b*, the sealant applicator machine 10 also includes one or more sealant supplies 300 operably coupled with the sealant-dispensing heads (100, 200). The one or more sealant supplies 300 may comprise one or more metering devices operably coupled with the sealant-dispensing heads (100, 200) to facilitate dispensing sealant.

The sealant applicator machine 10 is capable of dispensing (e.g., is adjustable to dispense) sealant arrangements of different widths. Thus, the sealant applicator machine 10 is capable of sealing different IG units having different pane separation widths. Different IG units require different sealant arrangement widths, e.g., because IG units have different pane separation distances. In some embodiments, the sealant arrangement width is equal to the pane separation distance. The sealant applicator machine 10 is configured to adjust (e.g., change) the sealant arrangement width, at least within a certain range, without having to change out any nozzles that dispense the sealant arrangement (i.e., without having to remove a nozzle from the machine and replace it with a different nozzle). In contrast, conventional systems require removing a first fixed width nozzle and replacing it with a second fixed width nozzle of a different width before it is possible to dispense a sealant arrangement of a different width. Interchanging nozzles to change the width of the sealant arrangement can be time-consuming, and therefore decreases efficiency. Thus, it will be appreciated that the present machine 10 is particularly beneficial for MTO production.

In the sealant applicator machine 10 of FIGS. 1*a-c*, either of the adjustable sealant-dispensing head 100 and the fixed width sealant-dispensing head 200 can be used/activated (i.e., operated selectively to apply sealant onto an IG unit). When one of the two sealant-dispensing heads (100 or 200) is activated, the other is not used (i.e., remains inactive insofar as sealant is not delivered from the inactive head onto the IG unit while the active head is delivering sealant to the IG unit). When one of the dispensing heads 100, 200 is activated, it preferably moves around the perimeter 27 of the IG unit 20 and dispenses sealant onto the IG unit 20. As is perhaps best shown in FIGS. 1*a* and 1*b*, both of the illustrated dispensing heads 100, 200 are part of an integral dispensing head assembly, which is movable as a unit about the perimeter of the IG unit 20. Thus, the inactive dispensing head also moves about the perimeter of the IG unit, but it does not dispense sealant and is oriented away (and spaced apart) from the edge of the IG unit. The alignment of the activated sealant-dispensing head (100 or 200) relative to the IG unit 20 during sealant application will be discussed later with respect to FIGS. 2*d* and 2*e*.

The adjustable sealant-dispensing head 100 can dispense sealant arrangements of different widths. For example, it can be used first to dispense onto a first IG unit a first sealant arrangement of a first width, and it can be subsequently used to dispense onto a second IG unit a second sealant arrangement of a second, different width. In such cases, the first and second IG units will typically have different pane separation distances and/or different spacer widths. Such two IG units may also (though need not always) have different perimeter shapes (e.g., the first IG unit may be a smaller square unit while the second IG unit is a larger rectangular unit).

Thus, the adjustable sealant-dispensing head 100 is adjustable, e.g., in situ (i.e., on the sealant applicator machine 40), to dispense sealant arrangements of different widths. This is perhaps best understood by referring to FIG. 2*f*. In contrast, the fixed width sealant-dispensing head 200 dispenses sealant arrangements 40' of a single (i.e., unchangeable) width. This is perhaps best appreciated by referring to FIG. 4*c*. The details of the adjustable sealant-dispensing head 100 and the resulting sealant arrangement 40 are described in more detail below with reference to FIGS. 2*a-f*. Preferably, the adjustable sealant-dispensing head 100 can be adjusted without conducting any disassembly of the sealant applicator machine 40. The details of the fixed width sealant-dispensing head 200 and the resulting sealant arrangement are described in more detail below with reference to FIGS. 4*a-c*.

Adjustable Sealant-Dispensing Head

Figure 2A:
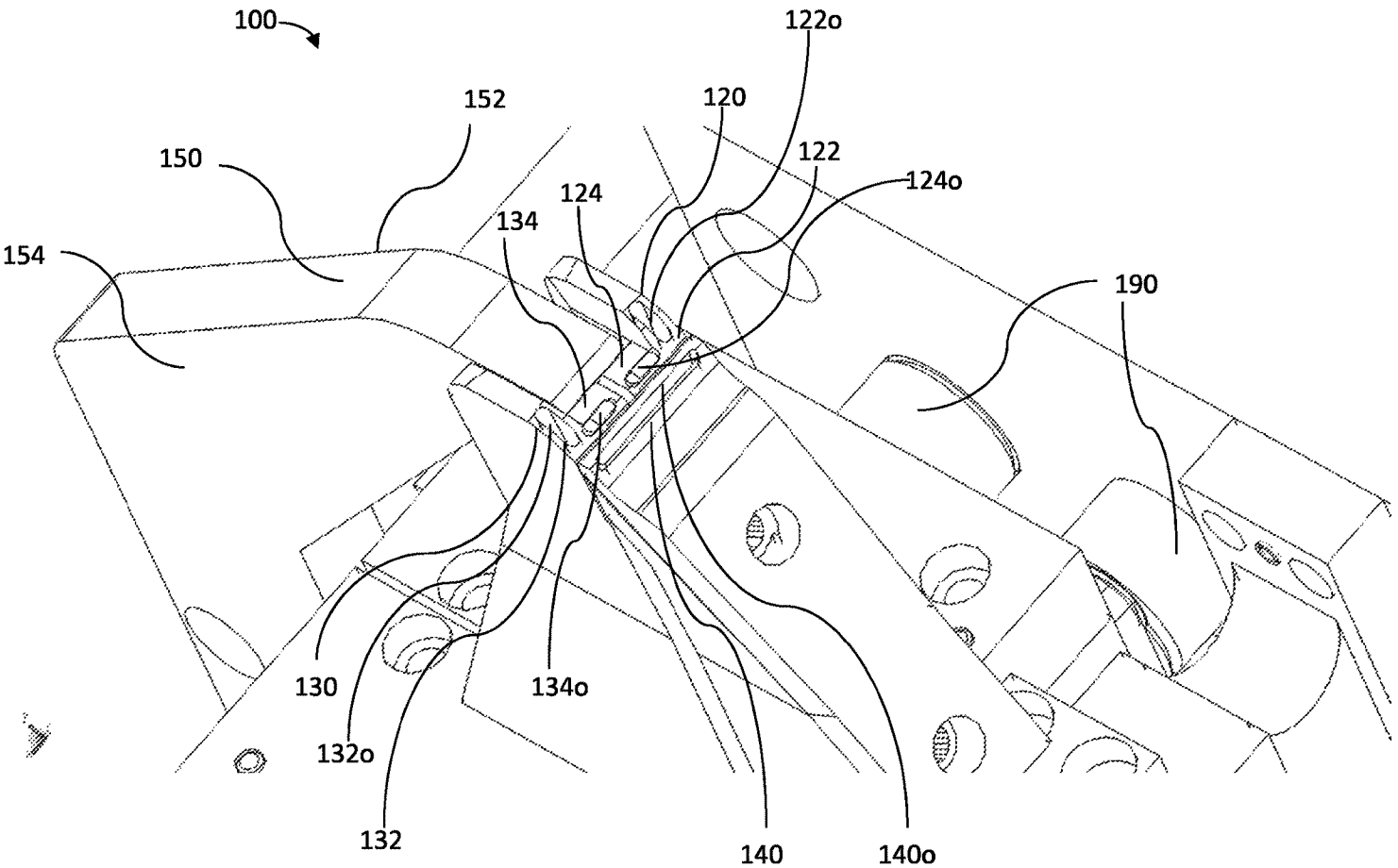
FIG. 2*a* is a close-up perspective view of the adjustable sealant-dispensing head of the sealant applicator machine of FIG. 1*a*.
Figure 2B:
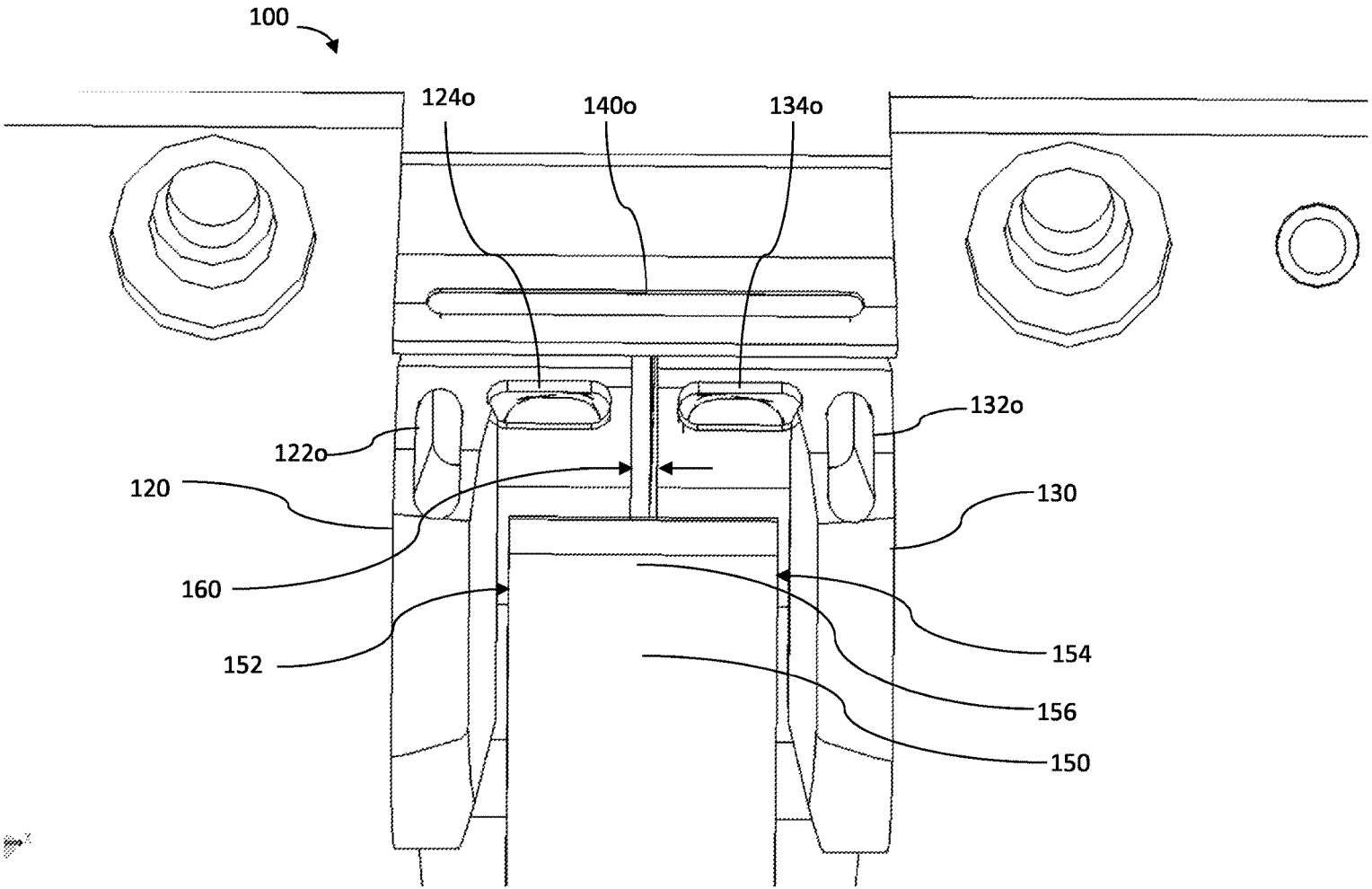
FIG. 2*b* is a close-up top view of the adjustable sealant-dispensing head of the sealant applicator machine of FIG. 1*a*.
Figure 2C:
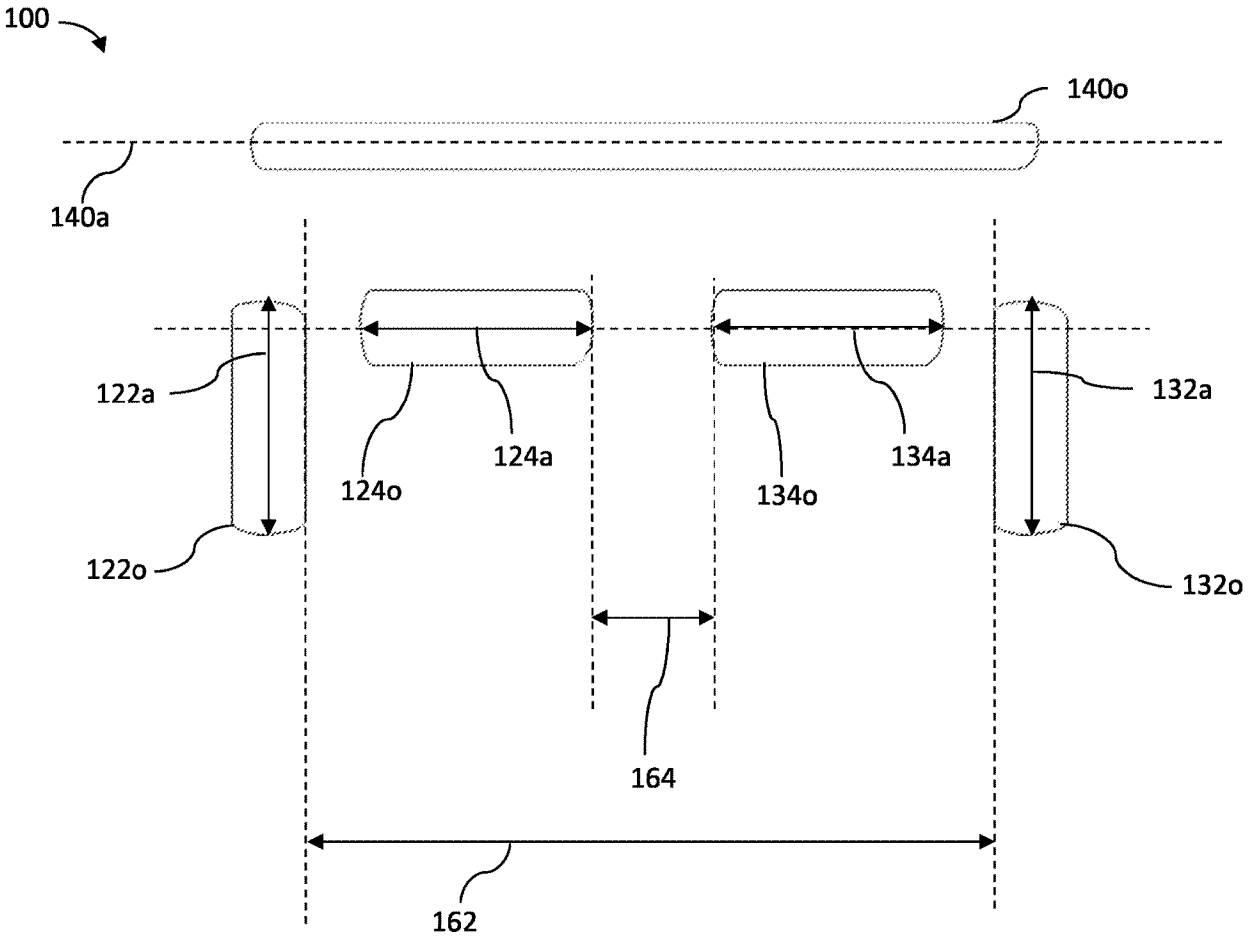
FIG. 2*c* is a schematic top view of the geometry of the adjustable sealant-dispensing head of FIG. 2*b*.

FIGS. 2*a-c* depict an illustrative embodiment of the adjustable sealant-dispensing head 100. FIG. 2*a* is a close-up perspective view, and FIG. 2*b* is a close-up top view, of the adjustable sealant-dispensing head 100. FIG. 2*c* is somewhat different from FIG. 2*b* in that it provides a schematic top view of the orifice geometry of the adjustable sealant-dispensing head 100 of FIG. 2*b*, without all details of the dispensing head shown in FIG. 2*b*.

As shown in FIGS. 2*a-c*, the adjustable sealant-dispensing head 100 includes a plurality of adjustable dispensing nozzles 122, 124, 132, 134. To facilitate dispensing sealant, the adjustable dispensing nozzles 122, 124, 132, 134 are operably coupled (e.g., so as to be in fluid communication) with the one or more sealant supplies 300 (FIG. 1*b*). The one or more sealant supplies 300 may comprise one or more metering devices adapted to pump, meter and/or supply sealant material to each of the adjustable dispensing nozzles 122, 124, 132, 134. Such one or more metering devices may be adapted to generate sealant flow through the adjustable sealant-dispensing head 100 using any desired pump system. The pump system may use gear pumps, piston pumps, or other types of positive displacement pumps, centrifugal pumps, internal or external gear pumps, lobe pumps, or vane pumps. Such one or more metering devices may also include valves, such as rotary spool valves or any other suitable valve.

The adjustable sealant-dispensing head 100 preferably includes one or more moveable nozzle portions. For example, the head can include an inner nozzle portion 120 and an outer nozzle portion 130, where at least one of these nozzle portions is moveable relative to (e.g., selectively toward and away from) the other. These nozzle portions are referred to herein as the inner nozzle portion 120 and the outer nozzle portion 130 for convenience. They are not geometrically or positionally limited by the designation of an "inner" nozzle portion 120 and an "outer" nozzle portion 130. They can alternatively be referred to as a first nozzle portion 120 and a second nozzle portion 130.

As best shown in FIG. 2*a-b*, the plurality of adjustable dispensing nozzles may include a first dispensing orifice 122*o* positioned on the inner nozzle portion 120, and a second dispensing orifice 132*o* positioned on the outer nozzle portion 130. A first separation distance 162 (FIG. 2*c*) between the first dispensing orifice 122*o* and the second dispensing orifice 132*o* is adjustable. Thus, when sealing a first IG unit, the first separation distance 162 can be set at a first distance, and when sealing a second IG unit, the first separation distance 162 can be set at a second, different distance. These two orifices 122*o*, 132*o* may each be configured to produce a bead 42 of sealant.

With continued reference to FIG. 2*a-b*, the plurality of adjustable dispensing nozzles may further include a third dispensing orifice 124*o* positioned on the inner nozzle portion 120, and a fourth dispensing orifice 134*o* positioned on the outer nozzle portion 130. A second separation distance 164 (FIG. 2*c*) between the third dispensing orifice 124*o* and the fourth dispensing orifice 134*o* is adjustable. Thus, when sealing a first IG unit, the second separation distance 164 can be set at a first distance, and when sealing a second IG unit, the second separation distance 164 can be set at a second, different distance.

As best shown in FIGS. 2*a-c*, the adjustable sealant-dispensing head 100 may also include a fifth dispensing orifice in the form of a fixed width dispensing orifice 140*o*. The fixed width dispensing orifice 140*o* may be operably coupled (e.g., so as to be in fluid communication) with the one or more metering devices 300. In some embodiments, the fixed width dispensing orifice 140*o* is maintained in a fixed relationship (e.g., at all times during operation) with respect to a guide 150 (discussed below). In some embodiments, the inner and outer nozzle portions 120, 130 are movable, selectively toward or away from each other (e.g., relative to the fixed width dispensing orifice 140*o* and/or the guide 150).

Figure 2E:
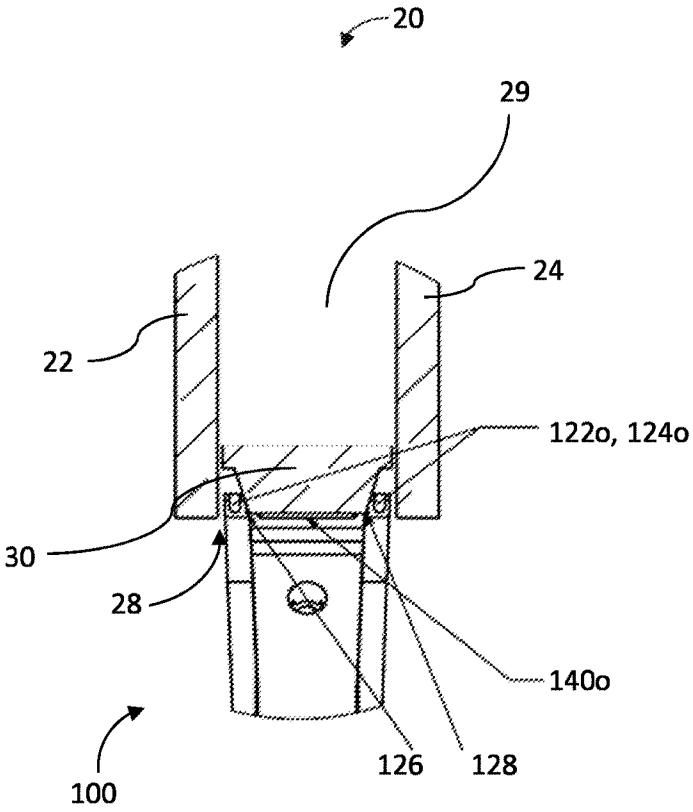
FIG. 2*e* is a cross-sectional side view of a portion of the adjustable sealant-dispensing head of FIG. 2*d*, positioned relative to the insulating glazing unit, as during dispensing of sealant, with the insulating glazing unit shown in cross section.
Figure 2D:
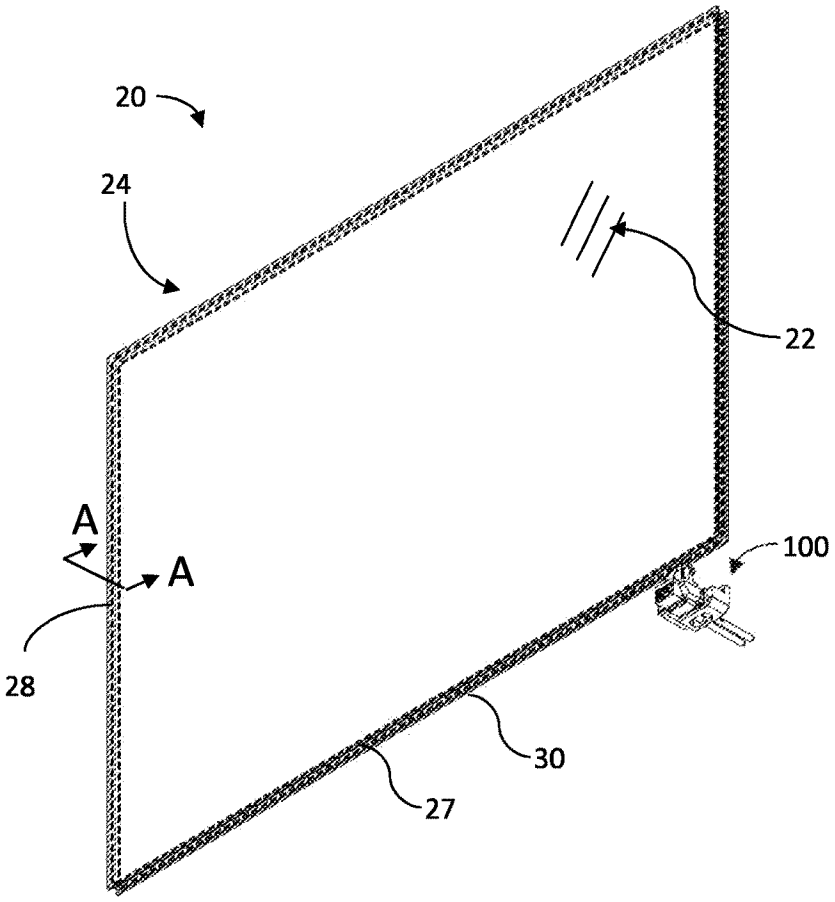
FIG. 2*d* is a perspective view of an insulating glazing unit and a portion of the adjustable sealant-dispensing head of FIG. 1*a* positioned to dispense sealant onto the IG unit.
Figure 2F:
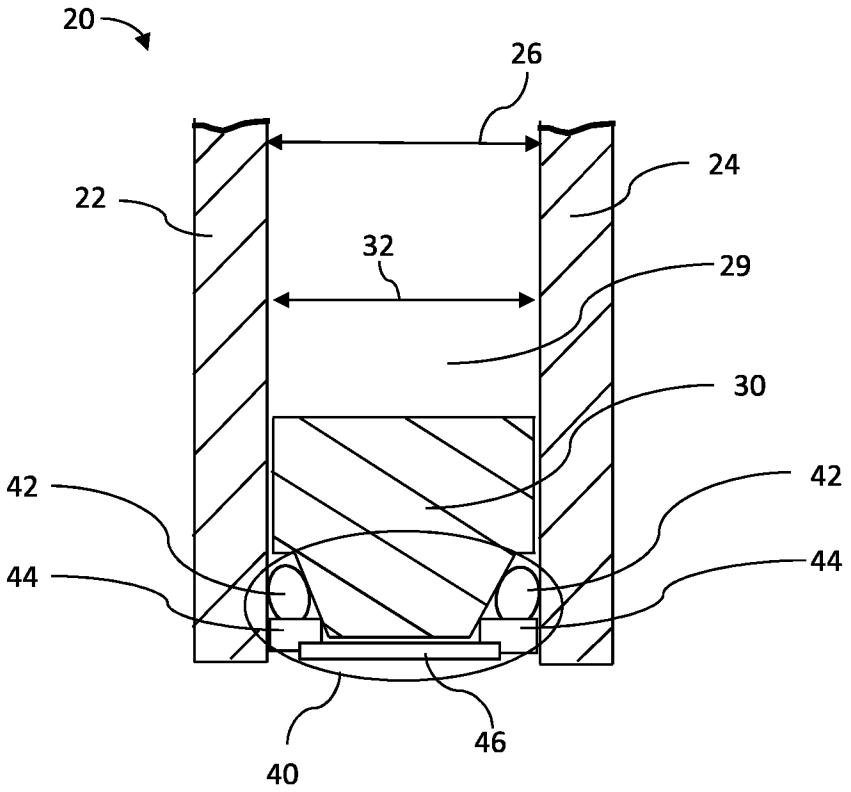
FIG. 2*f* is a cross-sectional view of a sealant arrangement geometry, shown through line A-A of FIG. 2*d*, produced by the adjustable sealant-dispensing head of FIG. 1*a*.

As is perhaps best appreciated by referring to FIG. 2*f*, adjusting the first and second separation distances 162, 164 can change the width of the resulting sealant arrangement 40. Adjusting the first separation distance 162 (FIG. 2*c*) changes the distance between two first beads 42 (FIG. 2*f*) of the sealant arrangement 40. Adjusting the second separation distance 164 (FIG. 2*c*) changes the distance between two second beads 44 (FIG. 2*f*) of the sealant arrangement 40. Thus, the distance between the first beads 42, as well as the distance between the second beads 44, can contribute to the overall width of the sealant arrangement 40.

In the sealant arrangement shown in FIG. 2*f*, the first 42 and second 44 beads of the sealant arrangement 40 define two opposed outermost end regions (which adhere to the panes) of the sealant arrangement and extend outwardly from (i.e., beyond) the third seal (or "skim coat") 46, which defines a central span of the sealant arrangement and does not contact the panes. In the embodiment illustrated, the first separation distance 162 and the second separation distance 164 are not independently adjustable. Rather, one adjustment changes them both simultaneously and to the same extent. In other embodiments, however, they can be independently adjustable.

The adjustable sealant-dispensing head 100 provides the benefit of being adjustable to dispense sealant arrangements 40 of different widths. The adjustable head 100 can seal IG units having a range of different pane separation distances 26 (FIG. 2*f*) without having to interchange (e.g., remove and replace) any nozzle. As just one example, the adjustable sealant-dispensing head 100 can be adapted (and used) to dispense a sealant arrangement 40 sized for a first IG unit having a pane separation distance 26 (FIG. 2*f*) of about 9 mm. Unlike conventional sealant-dispensing heads, the adjustable sealant-dispensing head 100 can also be adapted (and used) to dispense sealant arrangements 40 of other widths, such as a sealant arrangement 40 sized for a second IG unit having a pane separation distance 26 (FIG. 2*f*) of about 15 mm. The adjustable sealant-dispensing head 100 can be adjusted in this manner without the need to change out nozzles. In some embodiments, the adjustable sealant-dispensing head 100 can accommodate pane separation distances 26 (e.g., can dispense sealant arrangements having a width) ranging from about 9 mm to 15 mm. The adjustable nozzle, however, can be designed to accommodate other ranges.

Referring to the embodiment shown in FIG. 2*f*, the width of the sealant arrangement 40 is changed by changing the extent to which the third seal 46 overlaps the second beads 44. More generally, by adjusting an overlap extent between a skim coat and one or more sets of underlying sealant beads 42, 44, the overall/combined width of the skim coat and sealant beads can be changed. In some cases, there may only be one set of underlying sealant beads (i.e., 42 or 44, but not both). In FIG. 2*f*, both the first beads 42 and the second beads 44 contact the panes 22, 24, while the skim coat 46 does not.

As noted above, the adjustable head 100 is particularly advantageous for MTO production. In such production, the manufacturer may assemble a first IG unit having one spacer width and then (rather than constantly producing IG units of the same spacer width, as in made-to-stock, or "MTS," production) produce a second IG unit with a different spacer width, followed by a third IG unit with yet another spacer width, and so on. When the manufacturer must conduct nozzle change-outs each time a new spacer width is accommodated, efficiency is sacrificed. The present adjustable head 10 is an elegant solution to this problem.

With further regard to the inner and outer nozzle portions 120, 130, and as best shown in FIG. 2*b*, the inner nozzle portion 120 may include both the first and third dispensing orifices 122*o*, 124*o*. These orifices 122*o*, 124*o* can be located adjacent each other, in fixed relationship to each other, or both. In some embodiments, the inner nozzle portion 120 comprises a single integral body that defines both the first and third dispensing orifices 122*o*, 124*o*. Likewise, with respect to the outer nozzle portion 130, the second and fourth dispensing orifices 132*o*, 134*o* can be located adjacent each other, in fixed relationship to each other, or both. The outer nozzle portion 130 can comprise a single integral body that defines both the second and fourth dispensing orifices 132*o*, 134*o*. While the adjustable dispensing head is shown with two adjustable nozzle portions 120, 130, any suitable number of adjustable nozzle portions could be provided (e.g., 3, 4, or more).

The shape, orientation, and placement of the illustrated first, second, third, and fourth dispensing orifices 122*o*, 132*o*, 124*o*, 134*o* will now be described with reference to FIG. 2*c*. The illustrated first dispensing orifice 122*o* is a slot-shaped opening elongated along a first axis 122*a*, and the illustrated second dispensing orifice 132*o* is a slot-shaped opening elongated along a second axis 132*a*. The first axis 122*a* and the second axis 132*a* can optionally be parallel or substantially parallel to each other. The third dispensing orifice 124*o* can be a slot-shaped opening elongated along a third axis 124*a*, and the fourth dispensing orifice 134*o* can be a slot-shaped opening elongated along a fourth axis 134*a*. The third axis 124*a* and the fourth axis 134*a* can optionally be co-axial, substantially co-axial, or parallel to each other. In some embodiments, the first axis 122*a* is perpendicular or substantially perpendicular to the third axis 132*a*, while the second axis 124*a* is perpendicular or substantially perpendicular to the fourth axis 134*a*.

As best shown in FIGS. 2*a-b*, the illustrated adjustable dispensing head 100 includes a guide 150 located between the inner and outer nozzle portions 120, 130. When provided, the guide 150 can help align the adjustable sealant-dispensing head 100 with the IG unit 20 to be sealed. The guide 150 may comprise a plate having opposed first and second wall surfaces 152, 154 and an end surface 156 extending from the first wall surface 152 to the second wall surface 154. The end surface 156 may be configured to move along (or even project into) a perimeter channel 28 (FIG. 2*d-e*) of the IG unit 20 during movement of the adjustable sealant-dispensing head 100 along the perimeter 27 of the IG unit. The alignment of the adjustable sealant-dispensing head 100 relative to the IG unit 20 will be discussed later in further detail with reference to FIGS. 2*d-e*.

In the illustrative embodiment, the inner and outer nozzle portions 120, 130 are moveable such that a gap distance 160 (FIG. 2*b*) between the inner nozzle portion 120 and the outer nozzle portion 130 is adjustable. In more detail, the inner and outer nozzle portions 120, 130 are movable, selectively toward or away from each other (e.g., relative to the fixed width dispensing orifice 140*o*, an optional guide 150, or both), such that the gap distance 160 between the inner nozzle portion 120 and the outer nozzle portion 130 changes. This may involve just one of two nozzle portions moving toward or away from the other nozzle portion, or it may involve both nozzle portions so moving.

As best shown in FIG. 2*c*, the fixed width dispensing orifice 140*o* can optionally be a slot shaped opening elongated along a fifth axis 140*a*. The fifth axis 140*a* may be parallel or substantially parallel to the third and fourth axes 124*a*, 134*a*, and may be spaced apart from the third and fourth axes 124*a*, 134*a*. The fixed width dispensing orifice 140*o* may be located closer to the third and fourth dispensing orifices 124*o*, 134*o* than to the first and second dispensing orifices 122*o*, 132*o*. The fixed width orifice 140 preferably is configured to dispense a sheet of sealant (e.g., a skim coat), which can optionally span at least 50% (e.g., more than 65%) of the pane separation distance 26.

In alternate embodiments, the fixed width dispensing orifice 140*o* is provided together with only the first and second dispensing orifices 122*o*, 132*o*, while the third and fourth 124*o*, 134*o* dispensing orifices are omitted. In other embodiments, the fixed width dispensing orifice 140*o* may be provided together with only the second and third 124*o*, 134*o* dispensing orifices, while the first and second 122*o*, 132*o* dispensing orifices are omitted. In still other embodiments, the fixed width dispensing orifice 140*o* may be omitted in favor of simply providing the first and second 122*o*, 132*o* dispensing orifices or the second and third 124*o*, 134*o* dispensing orifices. Thus, the sealant arrangement 40 need not extend the entire distance between the two panes.

FIG. 2*d* is a perspective view of an IG unit 20 and a portion of the adjustable sealant-dispensing head 100 of FIG. 1*a* positioned for dispensing sealant onto the IG unit 20. In operation, the IG unit 20 may be held stationary during the dispensing/application process as the sealant applicator machine 10 is moved into engagement with the IG unit 20 and then around the perimeter 27 of the IG unit 20. When working with an IG unit of polygonal shape, the sealant applicator machine 10 is moved along a first side/edge of the IG unit (so as to dispense sealant onto that side/edge of the IG unit), and then moved along a second side/edge of the IG unit (so as to dispense sealant onto that side/edge of the IG unit). When the IG unit being processed is a rectangle or square, the machine is also subsequently moved along a third side/edge (so as to dispense sealant onto the third side/edge), and then moved along a fourth side/edge (so as to dispense sealant onto the fourth side/edge). In such cases, the sealant applicator machine 10 will typically turn three corners, and each time it turns a corner, the result will be a change in the linear direction of travel. In applications involving 90 degree corners, each such change will involve a 90 degree change in linear movement direction.

Figure 10A:
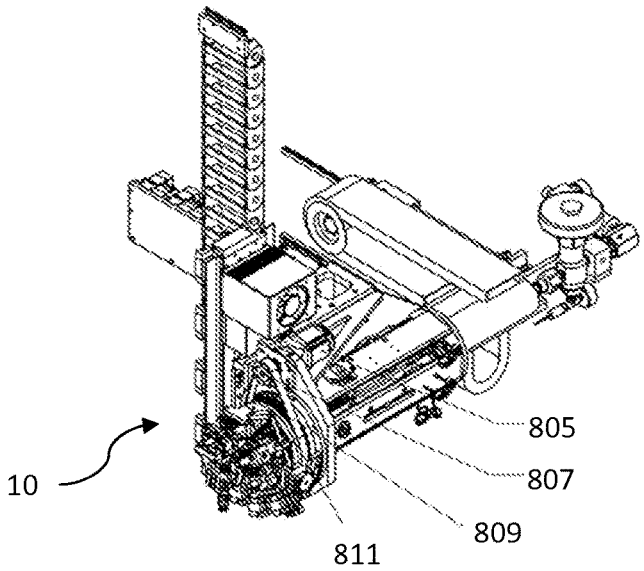
FIG. 10A is a perspective view of an embodiment of a sealant applicator machine including both an adjustable sealant-dispensing head and a fixed width sealant-dispensing head.

In order for the illustrated sealant applicator machine 10 to turn a corner, the adjustable sealant-dispensing head 100 is rotated about the Z axis 740. The machine 10 is thus constructed such that the adjustable sealant-dispensing head 100 (or at least a portion thereof) is rotatable about the Z axis 740. The machine can, for example, have a motor 805 positioned to rotate the adjustable sealant-dispensing head 100 (or a portion thereof) about the Z axis 740. The motor can advantageously be a servo 805 connected to the head assembly using a tooth belt 809 together with a driving pulley 807 and driven pulley 811 setup. Reference is made to FIG. 10A.

Thus, the machine may be configured to move an activated nozzle entirely about the perimeter of the IG unit 20, e.g., such that the activated nozzle applies sealant onto all of the sides/edges of the IG unit. Alternatively, the adjustable sealant-dispensing head 100 may be held stationary while the IG unit 20 is manipulated so as to move the entire perimeter 27 of the IG unit 20 past the sealant applicator machine 10. As still another alternative, one nozzle may seal less than all the sides of an IG unit while a second nozzle seals one or more other sides of the IG unit. Such nozzles may, for example, operate simultaneously on different sides of the IG unit.

FIG. 2*e* is a cross-sectional, broken-away side view of a portion of the adjustable sealant-dispensing head 100 of FIGS. 2*a-c*, positioned relative to an IG unit 20 for dispensing of the sealant arrangement 40. In FIG. 2*e*, the head 100 projects into a perimeter channel 28 of the IG unit 20. In more detail, a first orifice protrusion 126, which includes the first dispensing orifice 122*o*, and a second orifice protrusion 128, which includes the second dispensing orifice 132*o*, may both project into the perimeter channel 28 of the IG unit 20. This alignment provides for reliable dispensing of sealant between the first pane 22 and a first side portion of the spacer 30, and between the second pane 24 and a second side portion of the spacer 30. The guide 150 (FIG. 2*a-b*) can be configured to facilitate aligning the adjustable sealant-dispensing head 100 between the first and second panes 22, 24 of the IG unit 20, as shown in FIG. 2*e*. For example, the guide 150 may help align the head 100 relative to the IG unit 20 such that the first and second orifice protrusions 126, 128 both project into the perimeter channel 28 of the IG unit.

In alternate embodiments, the sealant applicator machine may include first and second adjustable sealant-dispensing heads, where one of the adjustable heads is capable of dispensing sealant arrangements with widths in a first range, and the other adjustable head is capable of dispensing sealant arrangements with widths in a second range (the first and second ranges being different).

Adjustable Sealant Arrangement Geometry

FIG. 2*f* is a cross-sectional view of the sealant arrangement 40 geometry produced by the adjustable sealant-dispensing head 100 of FIG. 1*a*. FIG. 2*f* is a cross-section taken through line A-A of the IG unit 20 of FIG. 2*d*. In this embodiment, the sealant arrangement 40 is produced by the first, second, third, fourth, and fixed width dispensing orifices 122*o*, 132*o*, 124*o*, 134*o*, 140*o*. The first adjustable seals (or "first beads") 42 result from the sealant dispensed by the first and second dispensing orifices 122*o*, 132*o*. In FIG. 2*f*, each first bead 42 has a generally oval or circular cross-sectional shape (i.e., in a cross-section perpendicular to the length of the bead), each second bead 44 has a generally rectangular cross-sectional shape, and the third seal 46 has a generally sheet-like cross-sectional shape. Here, the third seal 46 has a greater width (measured perpendicular to the confronting pane surfaces) than each second bead 44, and each second bead has a greater width than each first bead 42. It is to be appreciated, however, that various other bead/seal shapes and dimensions can be used.

The second adjustable seals (or "second beads") 44 result from the sealant dispensed by the third and fourth dispensing orifices 124*o*, 134*o*. The third seal (or "skim coat") 46 results from the sealant dispensed by the fixed width dispensing orifice 140*o*. As depicted in FIG. 2*f*, the first adjustable seals 42, the second adjustable seals 44, and the third seal 46 collectively form the illustrated sealant arrangement 40. Thus, the illustrated sealant arrangement 40 comprises five separate sealant deposits. In FIG. 2*f*, each of these five sealant deposits contacts one or two of the other four sealant deposits, such that all five sealant deposits form a single, continuous blanket (or "web") of sealant, which collectively covers the outer side of the spacer 30. The sealant arrangement 40 may extend along the entire perimeter of the IG unit 20. The illustrated sealant arrangement 40 spans the entire pane separation distance 26 of the IG unit 20.

In other embodiments, the sealant arrangement 40 may not include all of the first adjustable seals 42, the second adjustable seals 44, and the third seal 46. For example, the sealant arrangement 40 may include only the first and second adjustable seals 42, 44, or only the first adjustable seals 42, or only the second adjustable seals 44. Other sealant arrangement 40 combinations can also be used, such as only the first adjustable seals 42 and the third seal 46, or only the second adjustable seals 44 and the third seal 46. When provided, each first adjustable seal 42 and each second adjustable seal 44 preferably contacts both one of the panes 22, 24 and one side of the spacer 30.

Thus, one embodiment of the present invention provides an IG unit 20 having an adjustable sealant arrangement geometry of the nature described in this section of the present disclosure, shown in FIG. 2*f*, and/or described elsewhere in the present disclosure.

Sealant & Pane Materials

Sealant may be supplied to the adjustable nozzle 100 by supply tubes 190 (FIG. 2*a*). The sealant dispensed from each orifice may be the same. Alternatively, different sealant materials may be dispensed from different orifices. In some embodiments, the sealant may comprise polyisobutylene (PIB), silicone, a combination of PIB and silicone, or any other suitable material. The sealant may be extruded as a soft, pliant ribbon, bead, or coat.

With regard to the materials of the panes 22, 24, the panes 22, 24 can be formed of glass (e.g., soda-lime float glass). However, other transparent or translucent materials can also be used. Examples include acrylic thermoplastic and polycarbonate. Moreover, the panes 22, 24 may be formed of opaque materials in applications where it is not necessary to see through the panes 22, 24, such as spandrel applications.

Control System for Adjusting the Gap Distance

Figure 3A:
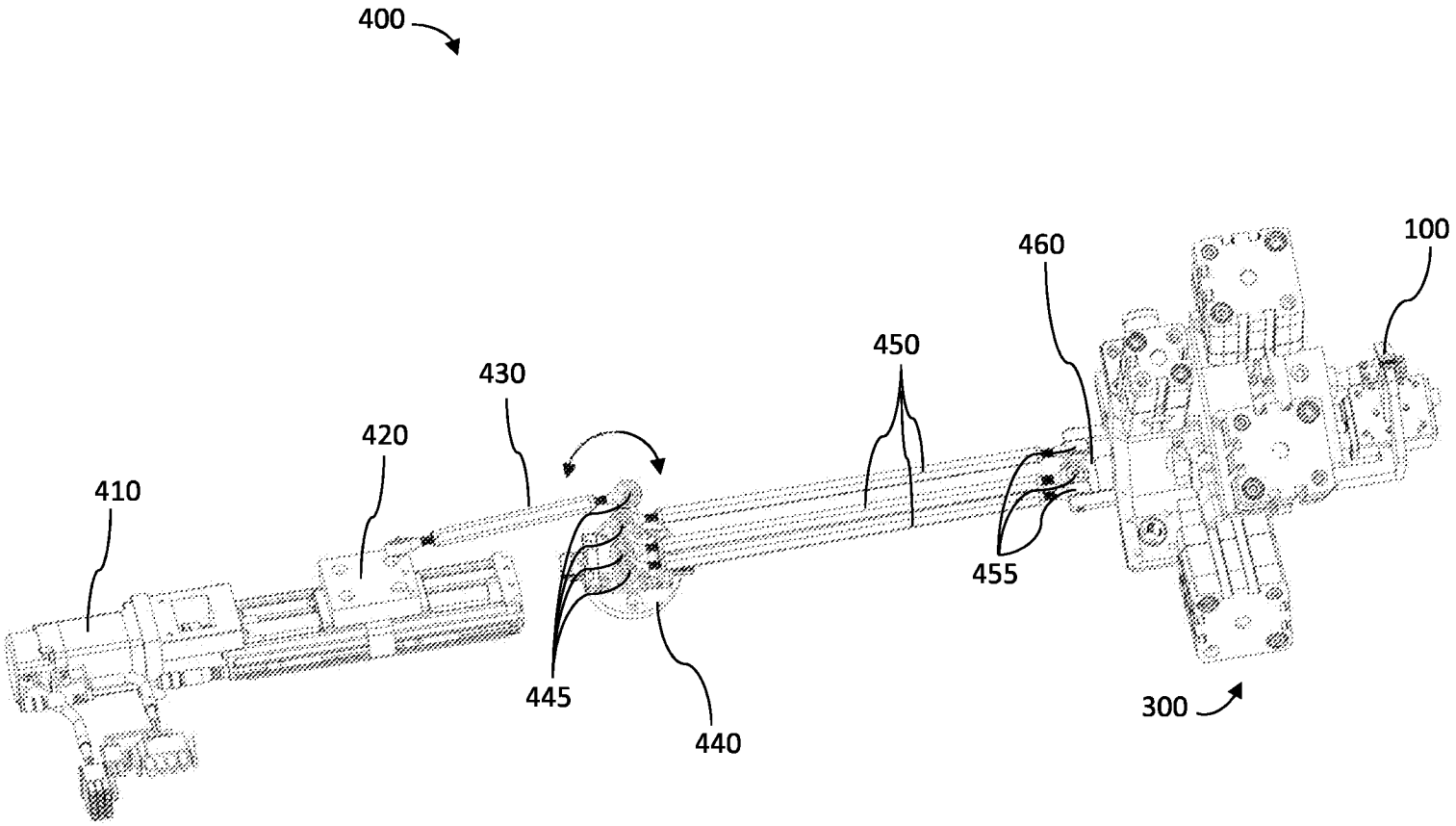
FIG. 3*a* is a perspective view of portions of the sealant applicator machine of FIG. 1*a* configured for a minimum gap distance between an inner nozzle and an outer nozzle of the adjustable sealant-dispensing head.
Figure 3B:
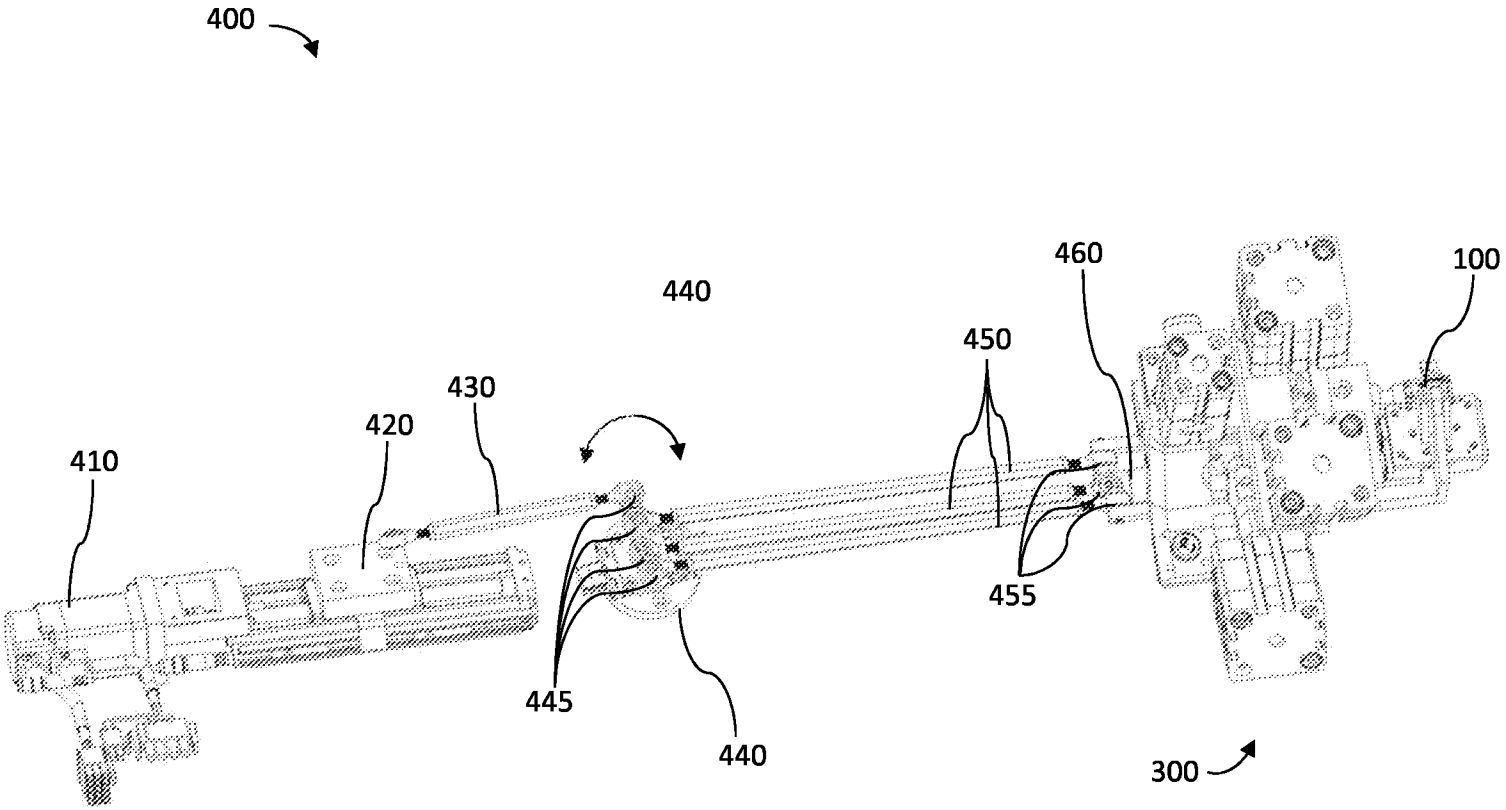
FIG. 3*b* is a perspective view of portions of the sealant applicator machine of FIG. 1*a* configured for a maximum gap distance between the inner nozzle and the outer nozzle of the adjustable sealant-dispensing head.

In the illustrative embodiment, the machine 10 has a control system 400 that adjusts the adjustable sealant-dispensing head 100. FIGS. 3*a* and 3*b* are perspective views of the sealant applicator machine 10 of FIG. 1*a* including the control system 400. To clearly show the control system 400, some other portions of the sealant applicator machine 10 are not shown in FIGS. 3*a-b*.

The illustrated control system 400 includes a motor 410 (e.g., a servo motor) powered by a power source (not shown), an actuator 420 (e.g., a linear actuator), a first tie rod 430, a rotation mechanism 440, first bushings 445, second tie rods 450, second bushings 455, and bracket assemblies 460. To adjust the gap distance 160 between the inner and outer nozzle portions 120, 130 (FIG. 2*b*), power can be applied to the motor 410 to linearly translate the actuator 420. The resulting movement of the actuator 420 moves the first tie rod 430 so as to impart a force, via one of the first bushings 445, to rotation mechanism 440. Upon application of this force, rotation mechanism 440 rotates and transfers force to second tie rods 450, via the other first bushings 445. Second tie rods 450 then transfer force, via second bushings 455, to bracket assemblies 460. In some embodiments, the bracket assemblies provide structural support and movement to the inner and outer nozzle portions 120, 130. The inner nozzle portion 120 is mounted to one of the bracket assemblies 460, and the outer nozzle portion 130 is mounted to another of the bracket assemblies 460. Moving the bracket assemblies 460 causes the nozzle portions 120, 130 to move relative to (e.g., selectively toward or away from) one another. As noted above, this movement of the nozzle portions 120, 130 adjusts the gap distance 160 (FIG. 2*b*).

FIG. 3*a* shows the control system 400 positioned for a minimum gap distance 160 (which could be zero) between the inner nozzle portion 120 and the outer nozzle portion 130 of the adjustable sealant-dispensing head 100. Such minimum gap distance 160 would be used when dispensing a sealant arrangement 40 having the smallest width that is dispensable with the adjustable head 100.

FIG. 3*b* shows the control system 400 positioned for a maximum gap distance 160 (FIG. 2*b*) between the inner nozzle portion 120 and the outer nozzle portion 130 of the adjustable sealant-dispensing head 100 of FIGS. 2*a-c*. Such maximum gap distance 160 would be used when dispensing a sealant arrangement 40 having the largest width that is dispensable with the adjustable head 100. Although FIGS. 3*a* and 3*b* look similar, FIG. 3*b* shows the rotation mechanism 440 rotated slightly counter-clockwise compared to FIG. 3*a*. In this embodiment, the counter-clockwise rotation of rotation mechanism 440 results in an increase in the gap distance 160 between the inner nozzle portion 120 and the outer nozzle portion 130 of the adjustable sealant-dispensing head 100.

Fixed Width Sealant-Dispensing Head

As previously described, the sealant applicator machine 10, in some embodiments, includes a fixed width sealant-dispensing head 200, in addition to the adjustable sealant-dispensing head 100. The fixed width sealant-dispensing head 200 will now be discussed in further detail with respect to FIGS. 4*a-c*. FIG. 4*a* is a close-up perspective view of the fixed width sealant-dispensing head 200 of the sealant applicator machine 10 of FIG. 1*a*. Here, the fixed width sealant-dispensing head 200 comprises a fixed width dispensing nozzle 210. The fixed width dispensing nozzle 210 is operably coupled to the one or more sealant supplies 300. The one or more sealant supplies may comprise metering devices in fluid communication with the fixed width dispensing nozzle 210 to provide (e.g., by pumping and metering) sealant material to the fixed width sealant-dispensing head 200. The preceding discussion of metering devices with respect to the adjustable sealant-dispensing head 100 also applies to the fixed width sealant-dispensing head 200. The nozzles and corresponding orifices described herein may be coupled to the same or different metering devices.

Unlike the adjustable sealant-dispensing head 100, the fixed width sealant-dispensing head 200 is not adjustable. Instead, the fixed width sealant-dispensing nozzle 210 is constructed to dispense sealant arrangements 40 of only a single width. Preferably, the fixed width dispensing nozzle 210 is mounted removably on the fixed width sealant-dispensing head 200 such that, upon removing the fixed width dispensing nozzle 210 from the fixed width sealant-dispensing head 200, a different fixed width dispensing nozzle can be mounted removably on the fixed width sealant-dispensing head 200. As is perhaps best appreciated by referring to both FIGS. 1*a* and 4*a*, the fixed width dispensing nozzle 210 can be removably attached to the illustrated underlying body by virtue of, for example, a plurality of removable fasteners, such as bolts or the like.

Thus, in some embodiments, two fixed width dispensing nozzles can be interchanged. The first fixed width dispensing nozzle 210 is constructed to dispense a sealant arrangement of a first width, and the second fixed width dispensing nozzle is constructed to dispense a sealant arrangement of a second width (the first and second widths being different). In a non-limiting example, the first and second widths may be different by at least 2 mm, or at least 4 mm. Thus, each fixed width dispensing nozzle 210 is constructed to dispense sealant arrangements of a single, particular (i.e., unchangeable) width.

Figure 4B:
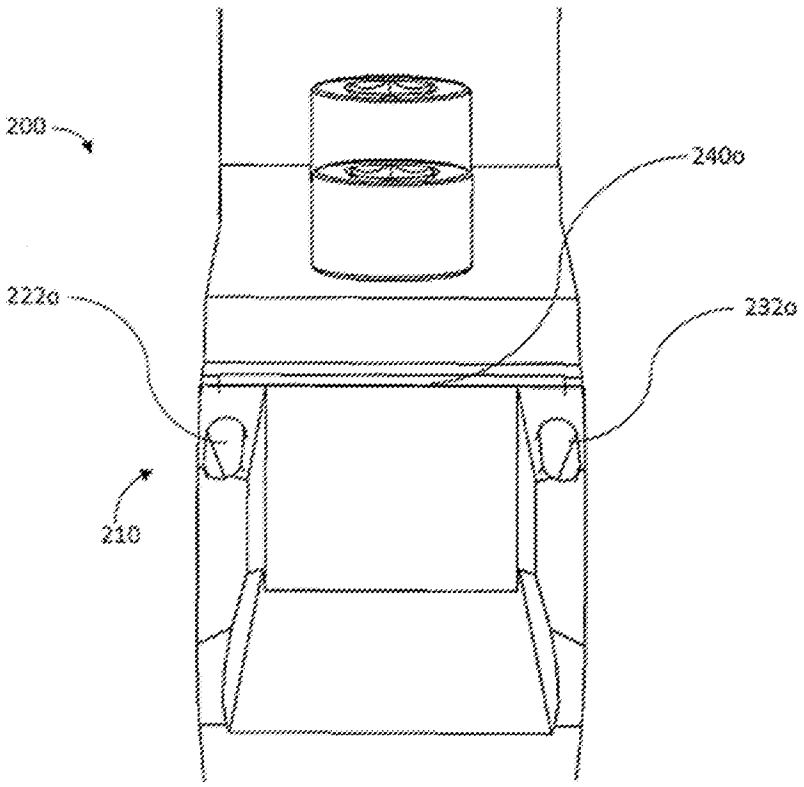
FIG. 4*b* is a close-up top view of the fixed sealant-dispensing head of the sealant applicator machine of FIG. 1*a*.
Figure 4C:
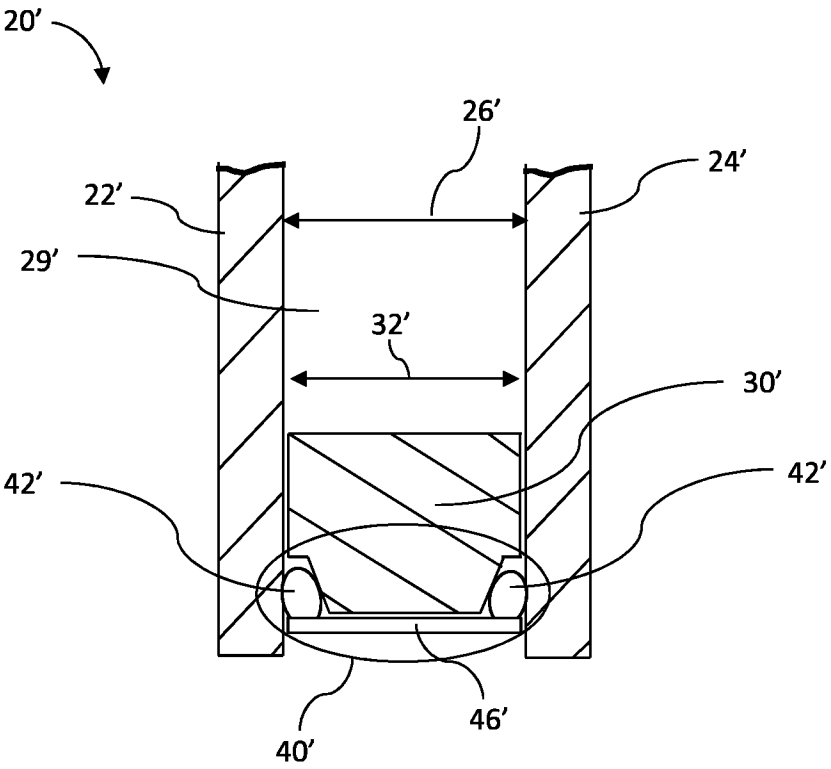
FIG. 4*c* is a cross sectional view of a sealant arrangement geometry produced by the fixed width sealant-dispensing head of FIG. 1*a*.

As best shown in FIGS. 4*a-b*, the fixed width sealant-dispensing head 200 may include a first bead orifice 222*o*, a second bead orifice 232*o*, and a skim orifice 240*o*. In the embodiment illustrated, the first bead orifice 222*o* is spaced apart from the second bead orifice 232*o*. The skim orifice 240*o* may be substantially perpendicular to both the first bead orifice 222*o* and the second bead orifice 232*o*. The distance between the first bead orifice 222*o* and the second bead orifice 232*o* is not adjustable, but rather is fixed.

The skim orifice 240*o* of the fixed width sealant-dispensing head 200 is similar to the fixed width dispensing orifice 140*o* of the adjustable sealant dispensing head 100. For example, it may span at least 50% (e.g., more than 65%) of the pane separation distance. The skim orifice 240*o* may be substantially perpendicular to both the first bead orifice 222*o* and second bead orifice 232*o*. The illustrated first and second bead orifices 222*o*, 232*o* and the skim orifice 240*o* are in fixed positions relative to one another. In other words, the positions of the first bead orifice 222*o*, the second bead orifice 232*o*, and the skim orifice 240*o* on the fixed width dispensing nozzle 210 are not adjustable relative to one another.

In some cases, the first and second bead orifices 222*o*, 232*o* of the fixed width sealant-dispensing head 200 are the same or substantially the same size and/or shape as the first and second dispensing orifices 122*o*, 132*o* of the adjustable sealant-dispensing head 100. The skim orifice 240*o* of the fixed width sealant-dispensing head 200 may also be the same or substantially the same size and/or shape as the fixed width dispensing orifice 140*o* of the adjustable sealant-dispensing head 200.

As noted above, the sealant applicator machine 10 can be used for made-to-stock ("MTS") production. In embodiments where the sealant applicator machine 10 includes a fixed width sealant-dispensing head 200, that head can be used advantageously during MTS production runs.

In the embodiments illustrated, when the fixed width sealant-dispensing head 200 is actuated, it is moved into engagement with an IG unit 20 and then around the perimeter 27 of the IG unit 20. As noted above, when working with an IG unit of polygonal shape, the sealant applicator machine 10 is moved along a first side/edge of the IG unit (so as to dispense sealant onto that side/edge of the IG unit), and then moved along a second side/edge of the IG unit (so as to dispense sealant onto that side/edge of the IG unit). When the IG unit being processed is a rectangle or square, the machine is also subsequently moved along a third side/edge (so as to dispense sealant onto the third side/edge), and then moved along a fourth side/edge (so as to dispense sealant onto the fourth side/edge). In such cases, the sealant applicator machine 10 will typically turn three corners, and each time it turns a corner, the result will be a change in the linear direction of travel. In applications involving 90 degree corners, each such change will involve a 90 degree change in linear movement direction.

When using the fixed width sealant-dispensing head 200, this head rotates about the Z axis 740 when the sealant applicator machine 10 turns a corner. The machine 10 is thus constructed such that the fixed width sealant-dispensing head 200 (or at least a portion thereof) is rotatable about the Z axis 740. The machine can, for example, have a motor 805 configured to rotate the fixed width sealant-dispensing head 200 about the Z axis 740. The motor 805 can advantageously be a servo connected to the head assembly (which comprises both the adjustable sealant applicator head 100 and the fixed width sealant-dispensing head 200), e.g., using a tooth belt 809 together with a driving pulley 807 and driven pulley 811 setup. Reference is made to FIG. 10A. In the embodiments illustrated, the head assembly (including both the adjustable sealant applicator head 100 and the fixed width sealant-dispensing head 200) travels about the perimeter of the IG unit during sealant application. Thus, the illustrated head assembly is rotatable about the Z axis.

Fixed Sealant Arrangement Geometry

FIG. 4*c* is a cross sectional view of the sealant arrangement 40' geometry produced by the fixed width sealant-dispensing head 200. This view is generally similar to the view depicted in FIG. 2*f*, which schematically shows the sealant arrangement 40 geometry produced by the adjustable sealant-dispensing head 100. Referring to FIG. 4*c*, the two bead seals 42' are dispensed from the first and second bead orifices 222*o*, 232*o*. The skim seal 46' is dispensed from the skim orifice 240*o*. Thus, the sealant arrangement 40' comprises three separate sealant deposits. In FIG. 4*c*, each of these three sealant deposits contacts one or both of the other two sealant deposits, such that all three sealant deposits form a single, continuous blanket (or "web") of sealant. The two bead seals 42' and the skim seal 46' collectively form the sealant arrangement 40', which is shown extending from the inner surface of the first pane 22' to the inner surface of the second pane 24', thereby entirely covering the outer wall of the spacer 30'.

Methods

Figure 5:
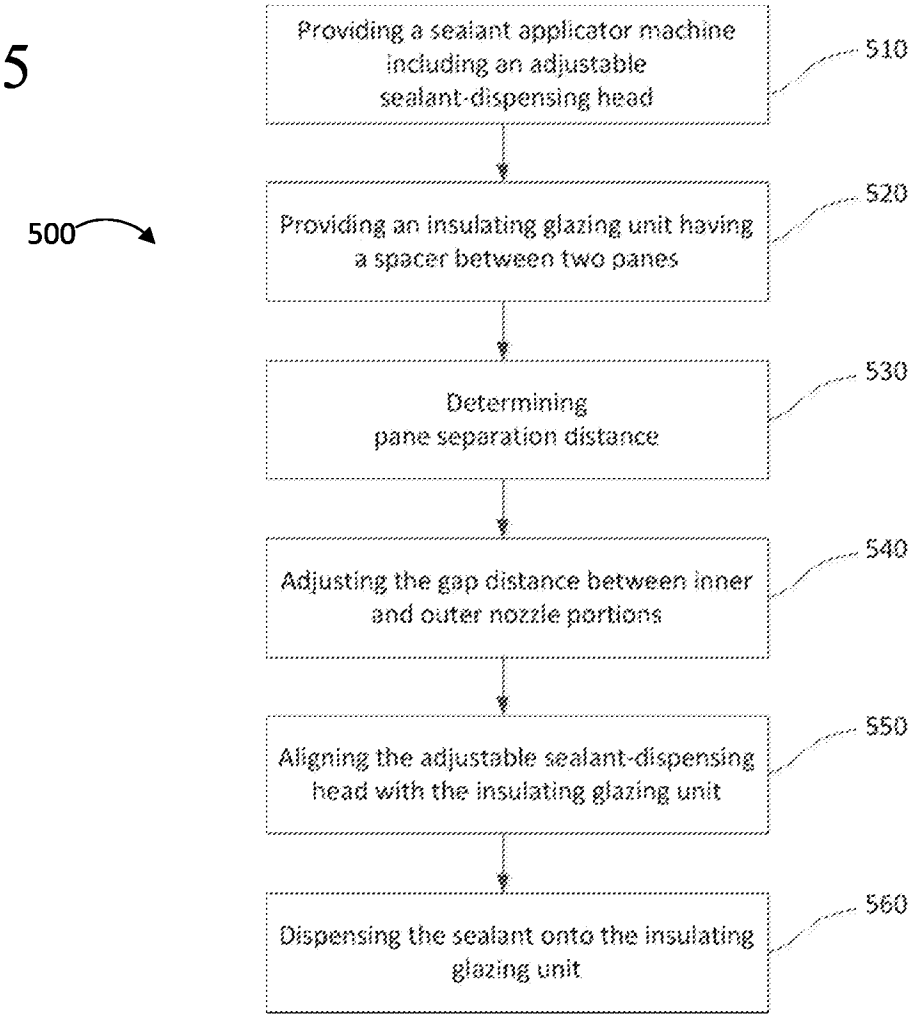
FIG. 5 illustrates a method of using the sealant applicator machine, including the adjustable sealant-dispensing head, of FIG. 1*a* to dispense sealant along a perimeter of an IG unit.

FIG. 5 is a flow chart illustrating an example method 500 for dispensing sealant arrangements 40 from an adjustable sealant-dispensing head 100 onto an IG unit 20. The adjustable sealant dispensing head 100 used in the present method may be of the nature shown in, and described above with respect to, FIGS. 1*a*-1*c* and 2*a*-2*e*. The reference numbers from those figures will be used to describe the present method. Method 500 involves providing an adjustable sealant-dispensing head 100 (step 510). The adjustable sealant-dispensing head 100 may include an inner nozzle portion 120 having a first dispensing orifice 122*o*, an outer nozzle portion 130 having a second dispensing orifice 132*o*, and one or more metering devices operably coupled with the first and second dispensing orifices 122*o*, 132*o*. Method 500 also involves providing an IG unit 20 having a spacer 30 located between first and second panes 22, 24 (Step 520).

Method 500 may further include determining the separation distance 26 (i.e., the distance between the panes 22, 24) of the IG unit 20 (Step 530), and/or determining the width of the spacer between the panes of the IG unit. Based on the separation distance 26 and/or spacer width, a gap distance 160 is adjusted between the inner nozzle portion 120 and the outer nozzle portion 130 (Step 540). With the gap distance 160 adjusted, the adjustable sealant-dispensing head 100 is aligned with the IG unit 20 so as to be adjacent to the panes 22, 24. This may involve actuating a motor that moves the adjustable sealant-dispensing head 100 along the Z axis (FIGS. 7*a*-7*e*), e.g., toward the edge of the IG unit to be sealed.

Figure 10B:
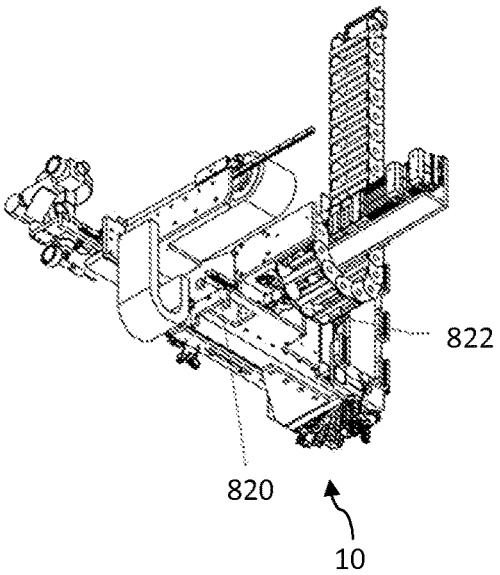
FIG. 10B is another perspective view of the sealant applicator machine of FIG. 10A.
Figure 10C:
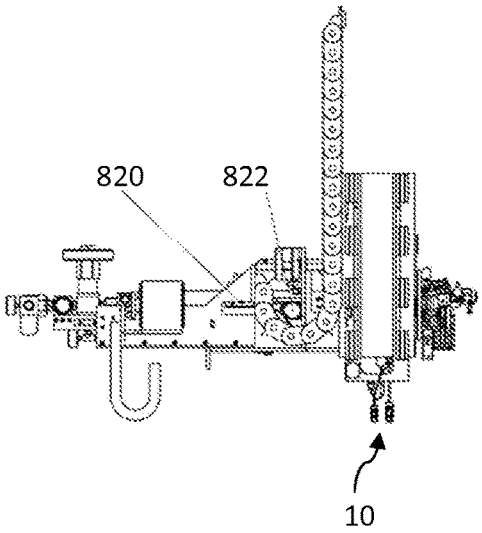
FIG. 10C is still another perspective view of the sealant applicator machine of FIG. 10A.

Thus, the machine 10 preferably is constructed such that the adjustable sealant-dispensing head 100 (or at least a portion thereof) is movable along the Z axis 740 (e.g., toward and away from an IG unit located at the working position). The machine 10 can, for example, have a motor 822 configured to move the adjustable sealant-dispensing head 100 along the Z axis 740. The motor 822 can advantageously be a servo with a pinion gear driving a rack gear 820 on the head assembly. Reference is made to FIGS. 10B and 10C. In the embodiments illustrated, the head assembly includes both the adjustable sealant applicator head 100 and the fixed width sealant-dispensing head 200. Thus, the head assembly preferably is movable along the Z axis 740. In some cases, the head assembly is moved toward (e.g., into engagement with) an IG unit to be sealed when sealant application is initiated. In such cases, the head assembly may later (e.g., upon completion of sealant application) be moved away from (e.g., out of engagement with) the IG unit.

Optionally, the adjustable sealant-dispensing head 100 is aligned so as to have one or more portions 126, 128 (see FIG. 2*e*) projecting into a perimeter channel 28 of the IG unit (Step 550). Once the adjustable sealant-dispensing head 100 has been aligned with the IG unit 20, the head 100 begins dispensing the sealant arrangement 40 onto (e.g., into a perimeter channel of) the IG unit 20 (Step 560). In step 560, dispensing the sealant arrangement 40 may include operating one or more metering devices 300 such that sealant is dispensed from the first and second dispensing orifices 122*o*, 132*o* onto the IG unit 20.

During the step of dispensing sealant onto the IG unit 20 with the adjustable sealant-dispensing head 100, the head preferably moves around the perimeter 27 of the IG unit. The head 100 is then moved along a first side of the perimeter 27 while dispensing sealant along the first side. Upon reaching a corner, the head 100 rotates (e.g., about the Z axis) so as to turn the corner and thereupon is oriented to dispense sealant as the head subsequently moves along the second side of the IG unit. This sequence of steps is repeated for each side of the IG unit, e.g., until the desired sealant arrangement has been applied about the entire perimeter of the IG unit. The resulting sealant arrangement 40 preferably forms an endless, uninterrupted seal, which extends entirely about the perimeter 27 of the IG unit.

Thus, when the head 100 turns a corner, it typically rotates by a certain number of degrees and afterward moves linearly in a direction offset (e.g., by the same number of degrees) from the direction in which it was moving linearly prior to turning the corner. For example, when the IG unit is rectangular or otherwise has one or more right corners, when the head 100 turns a corner, it rotates 90 degrees and afterward moves linearly in a direction offset by 90 degrees from the direction in which it was moving linearly prior to turning the corner. In some embodiments (e.g., with rectangular or square IG units), the method involves the head 100 turning at least three corners in the manner just described.

As noted above, the adjustable dispensing head 100 may have a guide 150 located between the inner nozzle portion 120 and the outer nozzle portion 130 (e.g., a portion of the guide may be located between sections of the inner and outer nozzle portions). In such cases, during movement of the adjustable head 100 around a perimeter 27 of the IG unit 20, the guide 150 can optionally be a leading portion of the adjustable sealant-dispensing head 100 while the inner and outer nozzle portions 120, 130 trail the guide.

Preferably, the adjustable sealant-dispensing head 100 also includes a fixed width dispensing orifice 140*o*, and the present method involves dispensing sealant from the fixed width dispensing orifice 140*o* onto the IG unit 20. In such cases, during movement of the adjustable head 100 around a perimeter 27 of the IG unit 20, the guide 150 (when provided) can optionally be a leading portion of the adjustable sealant-dispensing head 100, while the inner and outer nozzle portions 120, 130 trail the guide, and the fixed width dispensing orifice 140*o* trails the inner and outer nozzle portions. In the present method, when a fixed width dispensing orifice 140*o* is used, it can be of the nature described above with reference to FIGS. 2*b* and 2*c*.

In some embodiments, the adjustable sealant-dispensing head 100 further includes a third dispensing orifice 124*o*, which is positioned on the inner nozzle portion 120, and a fourth dispensing orifice 134*o*, which is positioned on the outer nozzle portion 130. In such embodiments, the method involves dispensing sealant from the third and fourth dispensing orifices 124*o*, 134*o* onto the IG unit 20 (as described with respect to FIGS. 2*b* and 2*c*).

When the adjustable sealant-dispensing head 100 is moved along the perimeter 27 of an IG unit 20, the first and second dispensing orifices 122*o*, 132*o* may be defined by leading portions of the adjustable sealant-dispensing head 100 while the fixed width dispensing orifice 140*o* may be defined by a trailing portion. Thus, when initiating movement of the adjustable head 100 around a perimeter 27 of the IG unit 20, the first beads 42 may be dispensed so as to contact the IG unit 20 first, followed closely by the second beads 44 being dispensed so as to contact the IG unit shortly thereafter (the second beads being applied over and/or against the first beads), followed closely by the skim coat 46 being dispensed so as to contact the IG unit shortly thereafter (the skim coat being applied last, e.g., as a cover laid at least partially over the second beads 44). As shown in FIG. 2*e*, the skim coat 46 may be deposited so as to contact the second beads 44, while the second beads are deposited so as to contact the first beads 42.

In step 540, the gap distance 160 between the inner nozzle portion 120 and the outer nozzle portion 130 is adjusted, optionally by moving the inner and outer nozzle portions 120, 130 selectively toward or away from each other (which may involve either moving one toward or away from the other, or moving both toward or away from each other). This may be accomplished, for example, by powering a motor 410 to move an actuator (e.g., a linear actuator) 420 such that a control system 400 of the machine changes the gap distance 160 between the inner 120 and outer 130 nozzle portions. Reference is made to the discussion above of FIGS. 3*a* and 3*b*.

In some embodiments, method 500 involves dispensing sealant onto a plurality of IG units 20, e.g., onto a first IG unit and subsequently onto a second IG unit. The first and second IG units each have first and second panes 22, 24 separated by a spacer 30. In some cases, the spacer 30 of the first IG unit has a first spacer width 32, while the spacer 30 of the second IG unit has a second spacer width 32. In the present embodiments, the first and second spacer widths are different, e.g., by at least 2 mm, at least 3 mm, at least 4 mm, or more. The adjustable sealant-dispensing head 100 is operated to dispense sealant onto both the first and second IG units, without interchanging nozzles. For example, the adjustable sealant-dispensing head 100 can be operated to dispense sealant onto the first IG unit, and then, without removing and replacing the nozzle, the head 100 can be operated to dispense sealant onto the second IG unit. This can be accomplished by adjusting the gap distance 160 between the inner and outer nozzle portions 120, 130 so as to change the width of the sealant arrangement dispensed from the head 100.

Thus, in some embodiments, method 500 is used to dispense sealant onto multiple IG units 20. For example, method 500 may include operating the adjustable sealant-dispensing head 100 to dispense a plurality of sealant arrangements 40, including a first sealant arrangement dispensed onto the first IG unit, then adjusting the gap distance 160 between the inner and outer nozzle portions 120, 130 (without removing and replacing any nozzle), and thereafter operating the adjustable sealant-dispensing head 100 to dispense a second sealant arrangement onto the second IG unit. In the present embodiments, the first and second sealant arrangements have different widths. In some cases, the first and second sealant arrangements have widths that differ by at least at least 2 mm, at least 3 mm, at least 4 mm, or more. The range of adjustability can be greater or less depending on the range of IG unit widths to be processed.

Figure 6:
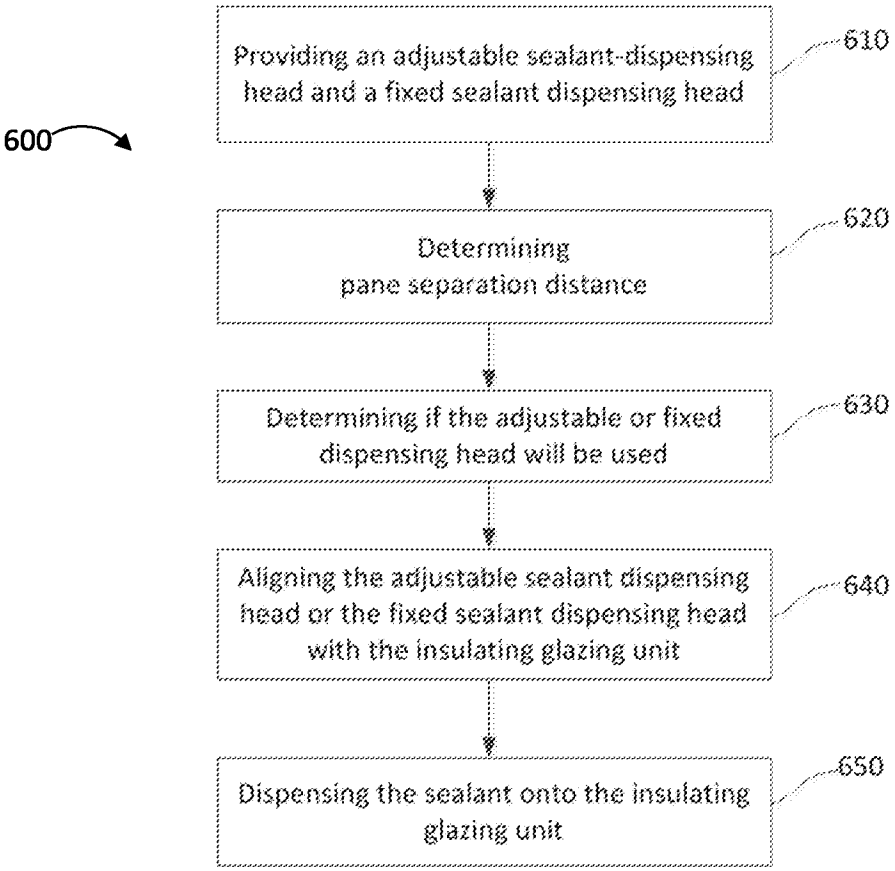
FIG. 6 illustrates a method of using the sealant applicator machine, including both the adjustable sealant-dispensing head and the fixed-width dispensing head, of FIG. 1*a* to dispense sealant along a perimeter of an IG unit.

FIG. 6 is a flow chart illustrating another method 600 of dispensing sealant arrangements 40, 40' onto an IG unit 20, 20'. Method 600 involves providing a sealant applicator machine 10 having both an adjustable sealant-dispensing head 100 and a fixed width sealant-dispensing head 200 (step 610). The adjustable sealant-dispensing head 100 may be of the type described above. The fixed width sealant-dispensing head 200 includes a fixed width dispensing nozzle 210, and may be of the nature described above. In some cases, the fixed width dispensing nozzle 210 includes a plurality of fixed dispensing orifices, such as spaced-apart first and second bead orifices 222*o*, 232*o*, optionally together with a skim orifice 240*o*. When provided, the skim orifice 240*o* may be spaced apart from the first and second bead orifices 222*o*, 232*o*.

In method 600, the fixed width sealant-dispensing head 200 is operable independent of the adjustable sealant-dispensing head 100. Thus, the machine 10 can be operated so as to selectively position either the fixed width sealant-dispensing head 200 or the adjustable sealant-dispensing head 100 against an IG unit 20 (at which point the machine may be operated to dispense sealant from the activated head onto the IG unit). For example, when it is desired to use the fixed width sealant-dispensing head 200, the machine can be operated so as to move that head 200 adjacent and/or against an edge of the IG unit (at which point head 200 can be operated to dispense sealant onto the edge of the IG unit), while the adjustable sealant-dispensing head 100 is held further away from (e.g., is oriented away from, or otherwise spaced apart from) the edge of the IG unit. In contrast, when it is desired to use the adjustable sealant-dispensing head 100, the machine can be operated so as to move that head 100 adjacent and/or against an edge of the IG unit (at which point head 100 may be operated to dispense sealant onto the edge of the IG unit), while the fixed width sealant-dispensing head 200 is held further away from (e.g., is oriented away from, or otherwise spaced apart from) the edge of the IG unit.

When the sealant applicator machine 10 is operated so as to selectively position either the fixed width sealant-dispensing head 200 or the adjustable sealant-dispensing head 100 against an IG unit 20, this may involve actuating a motor that moves the selected dispensing head along the Z axis (FIGS. 7*a*-7*e*), e.g., toward the edge of the IG unit to be sealed.

Method 600 includes providing an IG unit 20, 20' having a spacer 30, 30' between the panes 22, 24, 22', 24'. Method 600 also includes determining the pane separation distance 26, 26' of the IG unit 20, 20' (Step 620) and/or determining the spacer width. Based on the pane separation distance and/or the spacer width, either the adjustable sealant-dispensing head 100 or the fixed width sealant-dispensing head 200 is used to dispense the sealant arrangement 40, 40' onto the IG unit. For example, in step 630, a decision is made to selectively activate either the adjustable sealant-dispensing head 100 or the fixed width sealant-dispensing head 200, e.g., so as to move the chosen head around the perimeter 27, 27' of the IG unit 20, 20' while dispensing a sealant arrangement 40, 40' onto the IG unit 20, 20'. A pane separation distance 26 within a certain range may result in use of the adjustable sealant-dispensing head 100, whereas a pane separation distance 26' outside that range may require use of the fixed width sealant-dispensing head 200. In some cases, a determination that the spacer width is outside the operable range of the adjustable head 100 will require that the fixed width dispensing nozzle 210 be changed out in favor of another fixed width dispensing nozzle configured to dispense a sealant arrangement 40 of the width necessary to accommodate a particular pane separation distance 26.

Method 600 preferably includes aligning the adjustable sealant dispensing head 100 or the fixed sealant dispensing head 200 with the IG unit 20, 20' (Step 640) before dispensing sealant onto the IG unit. As noted above, this may involve orienting the other (i.e., non-selected) head away from the edge of the IG unit.

If the adjustable sealant-dispensing head 100 is used, the adjusting step 540 of FIG. 5 may also be involved in method 600. However, when the fixed width sealant-dispensing head 200 is to be used, the sealant arrangement 40' may be dispensed onto the IG unit 20' while the first bead orifice 222*o*, the second bead orifice 232*o*, and the skim orifice 240*o* are maintained in fixed positions relative to one another.

Regardless of which sealant dispensing head (100 or 200) is selected/activated, the active head preferably moves around the perimeter 27 of the IG unit. This involves moving the activated head along a first side of the perimeter 27 while dispensing sealant along the first side. Upon reaching a corner, the head rotates (e.g., about the Z axis) so as to turn the corner and thereupon is oriented to dispense sealant as the head subsequently moves along the second side of the IG unit. This sequence of steps is repeated for each side of the IG unit. The resulting sealant arrangement 40 preferably forms an endless, uninterrupted seal, which extends entirely about the perimeter 27 of the IG unit. The manner of turning corners and thereupon travelling in a new linear direction is, regardless of which sealant dispensing head is active, the same as has been described above with respect to the adjustable sealant-dispensing head 100.

Sealant Applicator Station

Certain embodiments of the invention provide a sealant applicator station 700. The station is configured to perform automated application of sealant to insulating glazing units. FIGS. 7*a*-7*e* depict one such embodiment wherein the station 700 includes a frame 702, a sealant applicator machine 10, and a substrate transport system 710. The frame 702 comprises a plurality of beams, preferably including upright and horizontal beams. The beams collectively form a support framework for the station 700. The sealant applicator machine 10 comprises an adjustable sealant-dispensing head 100 and a supply of sealant 750. The supply of sealant 750 may comprise one or more metering devices, as described previously. The adjustable sealant-dispensing head 100 comprises: i) an inner nozzle portion 120 having a first dispensing orifice 122*o*, and ii) an outer nozzle portion 130 having a second dispensing orifice 132*o*. The inner 120 and outer 130 nozzle portions are moveable (e.g., selectively toward or away from each other) so as to change a gap distance 160 between the inner nozzle portion and the outer nozzle portion, and thereby change a width of the sealant arrangement 40 that the adjustable sealant-dispensing head 100 is configured to dispense. The substrate transport system 710 preferably comprises a conveyor 707 elongated along a lateral axis LA of the sealant applicator station 700.

It can thus be appreciated that in certain embodiments, the sealant applicator machine 10 is part of a sealant applicator station 700 configured to perform automated application of sealant to insulating glazing units.

In FIGS. 7*a*-7*e*, the supply of sealant 750 comprises a sealant supply regulator. The sealant supply regulator controls the flow of sealant from a sealant source (e.g., a drum containing silicone sealant), which preferably is connected to the regulator by a flexible sealant line. At the back of the station, for example, there may be silicone drum unloaders that are connected to the sealant applicator machine 10 via the flexible sealant line (which may comprise flexible hose). A rotary connection of the sealant line to the sealant applicator machine 10 may be provided to allow for rotation of the sealant line, e.g., so as to facilitate movement of the applicator machine 10 about the perimeter of an IG unit 20.

In some of the present embodiments, the sealant applicator machine 10 further includes a fixed width sealant-dispensing head 200. When provided, the fixed width sealant-dispensing head 200 has a fixed width dispensing nozzle that is constructed to dispense sealant arrangements 40 of only a single width. The fixed width sealant-dispensing head 200 can be of the nature described above. More generally, the sealant applicator machine 10 of station 700 can be in accordance with any embodiment described in one or more previous sections of the present disclosure.

The sealant applicator station 700 is configured to receive an IG unit 20. FIGS. 7*a*-7*e* depict an embodiment wherein IG units are conveyed and processed on the station 700 while being maintained in an upright (e.g., substantially vertical) orientation. The station, however, can alternatively be embodied such that the IG units are conveyed and processed in a substantially horizontal position.

In FIGS. 7*a*-7*e*, the substrate transport system 710 defines a path of substrate travel extending along a lateral axis LA of the sealant applicator station 700. Preferably, the path of substrate travel extends between a station inlet 701 and a station outlet 709.

The substrate transport system 710 can be provided in different forms. Preferably, it is configured to convey an IG unit 20 to a working position of the station 700 whereupon the IG unit is held stationary (see FIGS. 7*b*-7*e*) while the sealant applicator machine 10 is moved around the perimeter of the IG unit so as to apply sealant to the IG unit.

In the embodiment of FIGS. 7*a*-7*e*, the substrate transport system 710 includes not only the conveyor 707, but also an inlet carriage 710*a* and an outlet carriage 710*b*. Each carriage has one or more suction cups 760 configured to handle the rear pane 22 of the IG unit 20. Preferably, each carriage has a series of suction cups spaced apart along the lateral axis LA. Each carriage 710*a*, 710*b* rides on a rail that extends along the lateral axis LA.

The bottom edge of the IG unit 20 rests on the conveyor 707 while the conveyor is driven so as to move the IG unit downstream along the lateral axis LA. The conveyor 707 preferably extends from the station inlet to a first (or "default" or "upstream") position of the inlet carriage 710*a*. In such cases, an IG unit 20 can be conveyed by the conveyor 707 to the inlet carriage 710*a*, which is in its first position. Once the IG unit reaches the inlet carriage, the conveyor can be stopped, and one or more suction cups 760 of the inlet carriage can be activated so as to be secured to the rear pane 24 of the IG unit (i.e., so as to hold the IG unit). The inlet carriage 710*a* can then move from its first position to a second (or "downstream") position, while carrying the IG unit 20. The second position of the inlet carriage 710*a*, which is further downstream along the lateral axis LA, preferably coincides with the working position of the station. When the IG unit 20 reaches this position, one or more suction cups 760 of the outlet carriage 710*b* can be activated so as to be secured to the rear pane 24 of the IG unit (i.e., so as to hold the IG unit). The previously activated suction cup(s) 760 of the inlet carriage 710*a* can then be deactivated, and thereby released from the IG unit. The inlet carriage 710*a* can then move back to its first position, leaving the outlet carriage 710*b* holding the IG unit 20.

Figure 9:
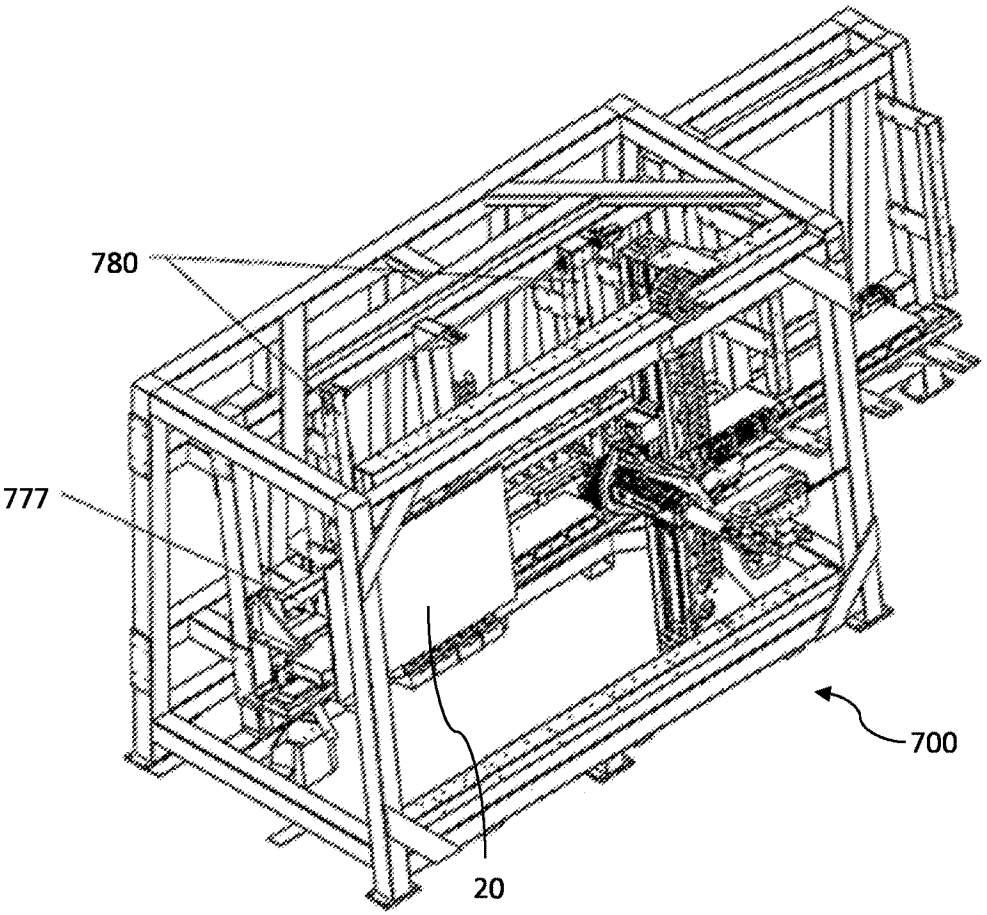
FIG. 9 is a perspective view of a sealant applicator station in accordance with still another embodiment of the invention.

The station 700 can optionally include a moveable rear support 777 against which an upper region of the rear pane 24 of the IG unit 20 is carried during sealant application. When provided, the moveable rear support 777 can be moveable substantially vertically so as to be aligned with an upper region of the IG unit 20 being processed. The moveable rear support 777 can, for example, be mounted for movement along a plurality of upright beams 780. The moveable rear support 777 can comprise an elongated wall or beam. In such cases, the elongated wall or beam may be mounted at its two opposed end regions to two upright beams of the nature just described. When provided, the moveable rear support facilitates MTO production in that its operative position can be adjusted along a certain vertical range so as to coincide with (and support) the upper region of IG units of different sizes. The moveable rear support 777 can optionally have one or more rollers or suction cups configured to engage the rear upper region of the IG unit 20 being processed. For example, the moveable rear support can comprise a beam that is elongated along the lateral axis LA and has a series of rollers spaced apart along a lateral length of the wall or beam. Reference is made to FIG. 9. Here, the moveable rear support 777 comprises a horizontally elongated bar having a plurality of rollers positioned to support the upper region of the rear pane 24 of the IG unit 20. A plurality of upright beams 780 are provided with linear drives to change the height of the support rollers so as to accommodate IG units of different sizes.

Thus, any of the methods described herein may include adjusting the elevation (or vertical position) of an optional moveable rear support 777 so as to align it with an upper region of the IG unit 20 being processed. In some cases, the rear support 777 includes one or more rollers, and the method includes positioning them so as to contact the upper region of the rear pane 24 of the IG unit 20. Preferably, this is done before starting the sealant application step described herein. In certain methods, the moveable rear support 777 is moved to a first elevation so as to support a first IG unit of a particular size (followed by applying sealant to that IG unit), and subsequently the support 777 is moved to a second elevation (which may be, for example, more than one inch above or below the first elevation) so as to support a subsequent IG unit of a different size (followed by applying sealant to that subsequent IG unit).

With the IG unit 20 held securely at the working position of the station 700, the sealant applicator machine 10 is operated so as to move about the perimeter of the IG unit while applying sealant thereto. This is described in more detail in the Methods section above, as well as in discussions below.

Once this sealant application step has been completed, the outlet carriage 710*b* can be moved to a downstream position, while carrying the IG unit 20. Upon reaching the downstream position of the outlet carriage 710*b*, the previously activated suction cup(s) 760 of the outlet carriage 710*b* can be deactivated, so as to release the IG unit.

Figure 8:
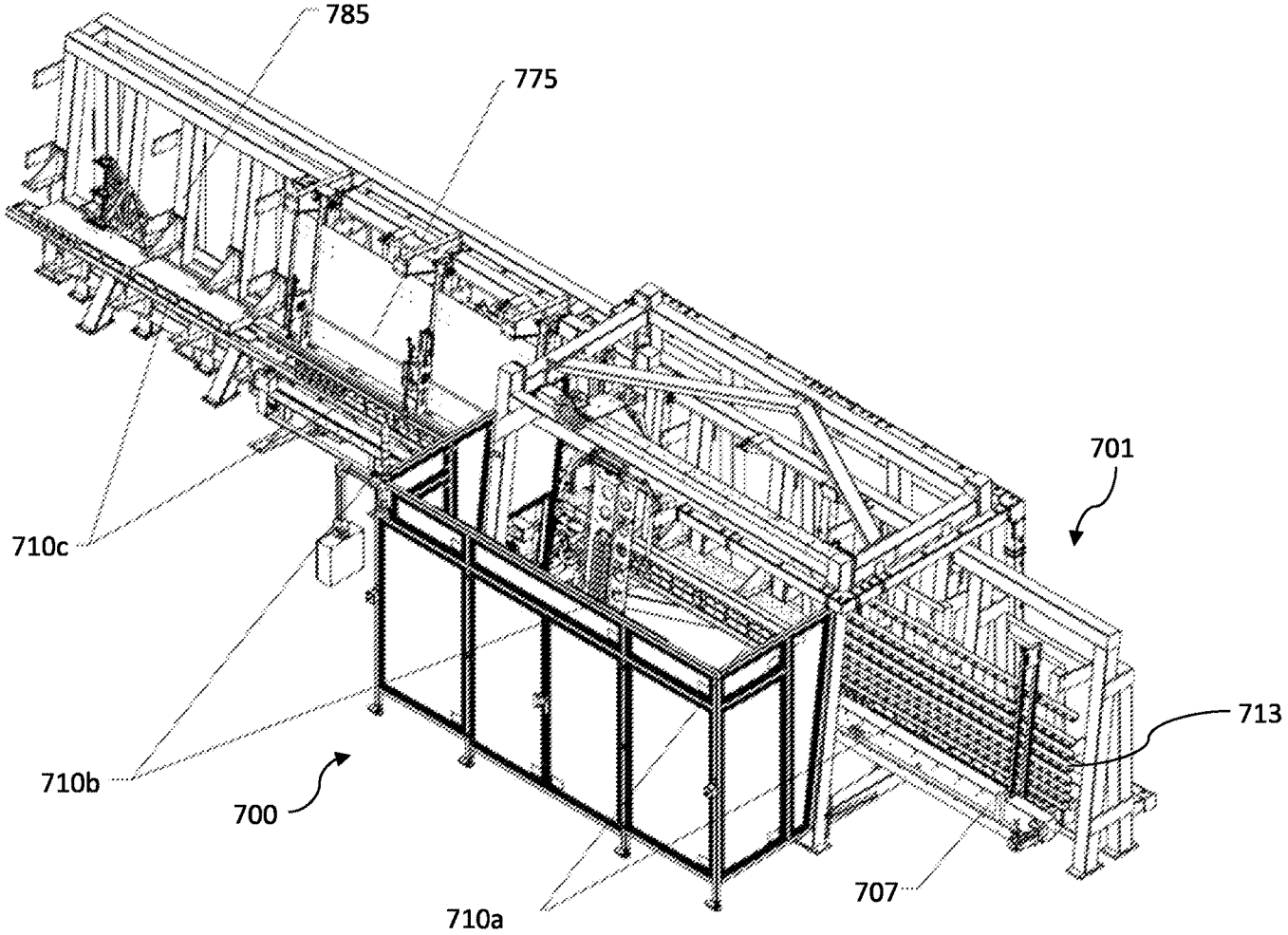
FIG. 8 is a perspective view of a sealant applicator station in accordance with another embodiment of the invention.

At this point, if desired, the IG unit can simply be unloaded manually from the outlet carriage (e.g., at an optional manual unload station 775: see FIG. 8). Another option is to have the IG unit drop down slightly onto an egress conveyor (not shown), which can then be activated to convey the sealed IG unit out of the sealant applicator station. In still another option, upon reaching the downstream position of the outlet carriage 710*b*, the IG unit 20 is handed-off from the outlet carriage 710*b* to a robot carriage 710*c*, which then carries the IG unit to an optional robot unload station 785. Reference is made to FIG. 8.

The conveyor 707 may be adapted for moving (e.g., conveying) an IG unit 20 along the path of substrate travel while maintaining the IG unit in a vertical-offset configuration. In this configuration, a top edge of the IG unit 20 is slightly closer (along the Z axis 740) to the back of the station 700 than is its bottom edge. Thus, the IG unit 20 is not perfectly vertical, but rather leans back a few degrees (e.g., about 7 degrees).

The conveyor 707 can comprise, for example, one or more endless conveyor belts driven so as to move the IG unit 20 downstream along the lateral axis LA of the station 700. The conveyor 707 preferably is coupled with a rear support 713. Thus, when the IG unit 20 is conveyed by the conveyor 707, the IG unit is supported by (e.g., by virtue of its rear pane 24 being in direct physical contact with) a rear support 713. The rear support 713 can be provided in different forms. For example, it can comprise a framework, platen, or both. In the embodiment of FIG. 8, the rear support 713 comprises a framework. When a platen is used, the platen may define a front surface alongside which the IG unit can be carried (e.g., against which the IG unit can slide) during conveyance of the IG unit along the rear support.

If desired, the rear support 713 (whether comprising a platen, a framework, or both) can include a plurality of rotatable bodies (e.g., wheels) adapted to roll against the rear pane 24 of the IG unit 20 during conveyance. When provided, such rotatable bodies may be mounted in fixed positions relative to (e.g., on) the rear support 713. Each such rotatable body can optionally be mounted in a fixed location where it is adapted to rotate about a generally vertical axis. Thus, the rear support 713 can optionally comprise a plurality of rotatable wheels. Additionally or alternatively, the rear support 713 can comprise a plurality of casters, which are free to rotate in any direction. Such wheels and/or casters can be provided as an arrangement (e.g., a matrix) wherein they are spaced vertically and horizontally from one another. When provided, the wheels are oriented so their direction of rotation corresponds to the desired direction of substrate travel (e.g., such wheels preferably are adapted for rotation about a common axis). Another option is to provide the rear support with an air cushion (e.g., a plurality of nozzles providing an air cushion) for supporting the rear pane 24 of the IG unit 20 during conveyance.

In some cases, an optional upstream conveyor is configured to deliver IG units from an upstream series of IG unit assembly machines to the sealant applicator station (e.g., via the station inlet). Thus, the sealant applicator station 700 can advantageously be part of an IG unit assembly line having a series of automated IG unit assembly stations.

Figure 7A:
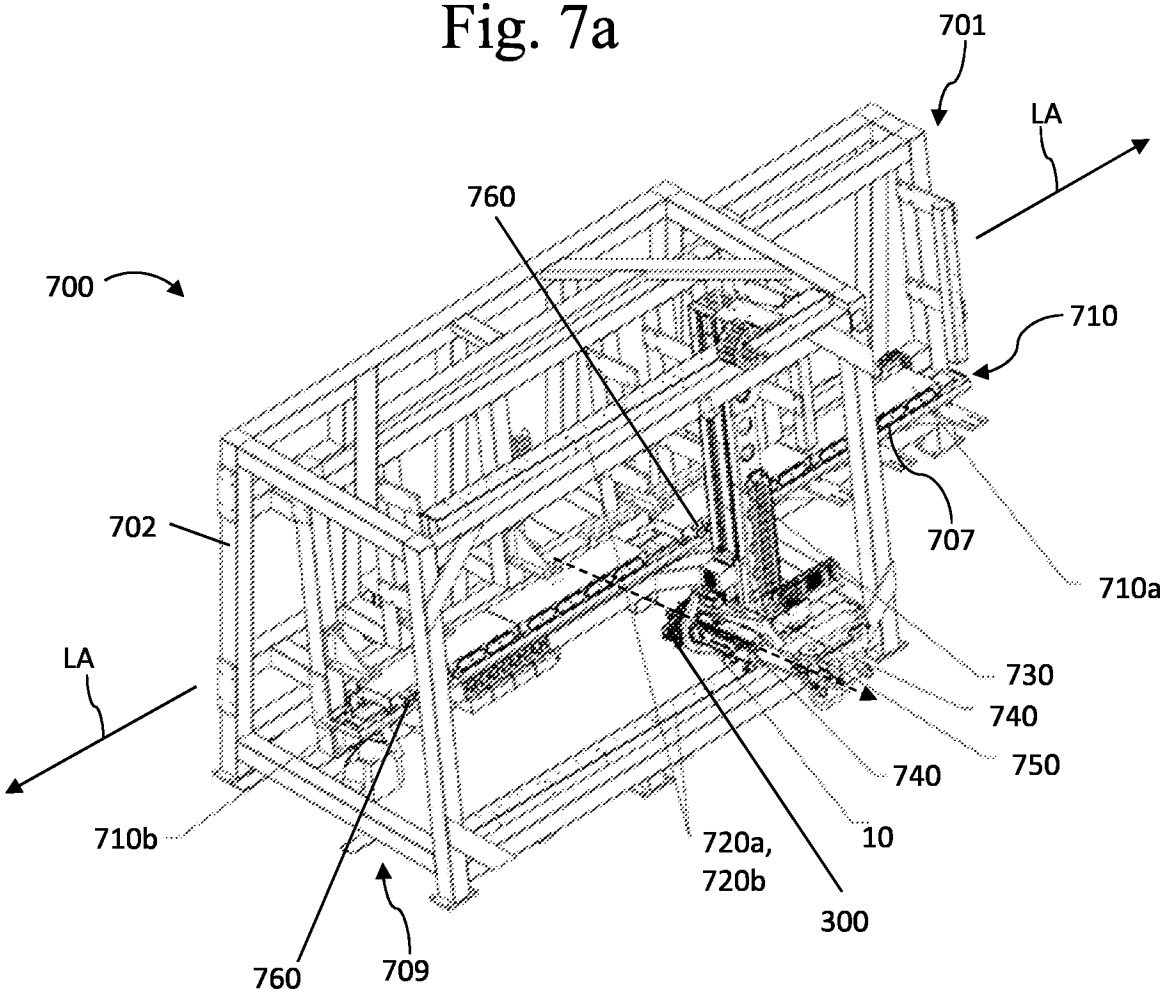
FIG. 7*a* is a perspective view of a sealant applicator station, shown before an IG unit has been delivered to the station, in accordance with certain embodiments of the invention.
Figure 7B:
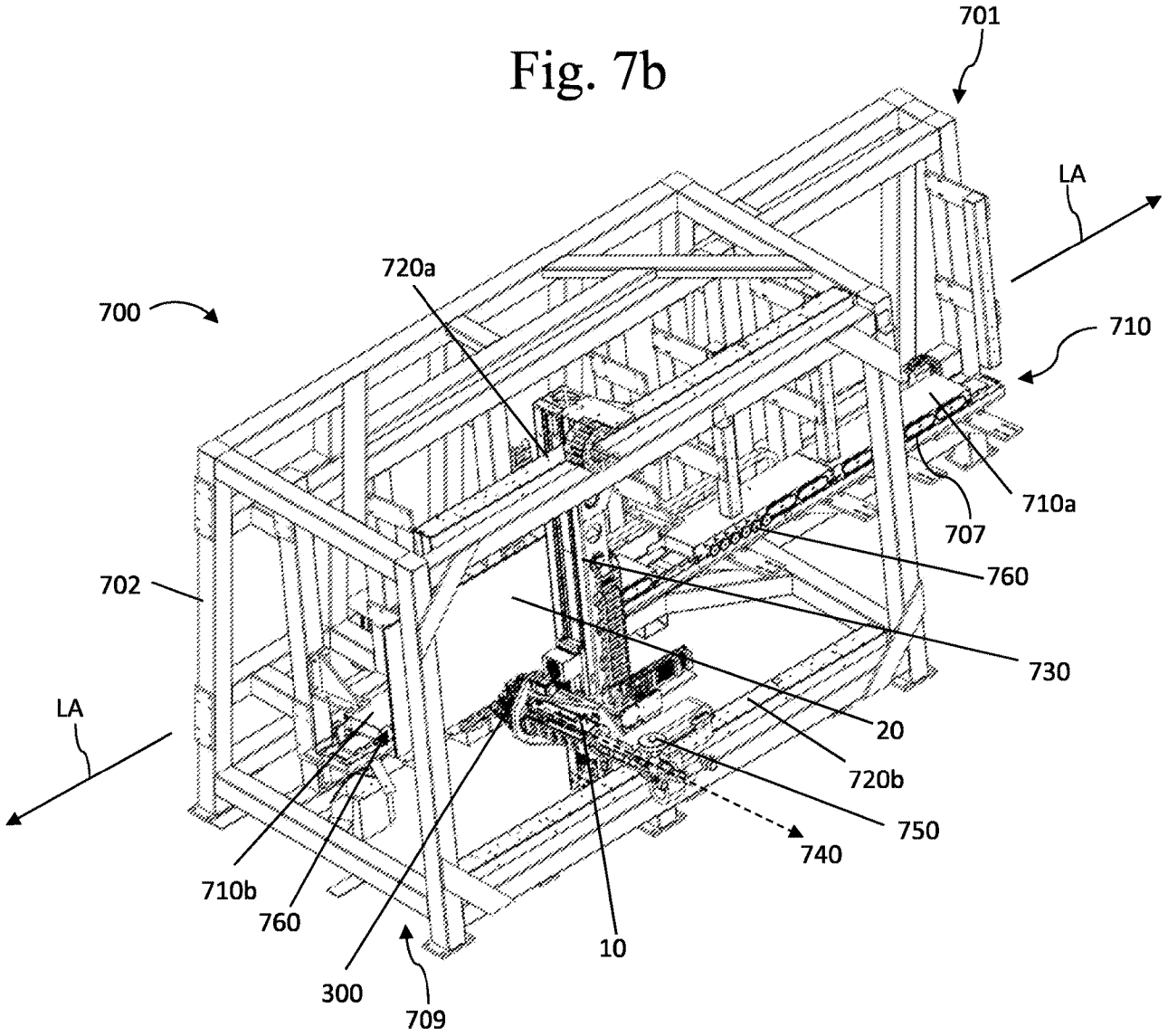
FIG. 7*b* is a perspective view of the sealant applicator station of FIG. 7*a*, shown with an IG unit on the station and a sealant applicator head delivering sealant onto a first side of the IG unit.
Figure 7C:
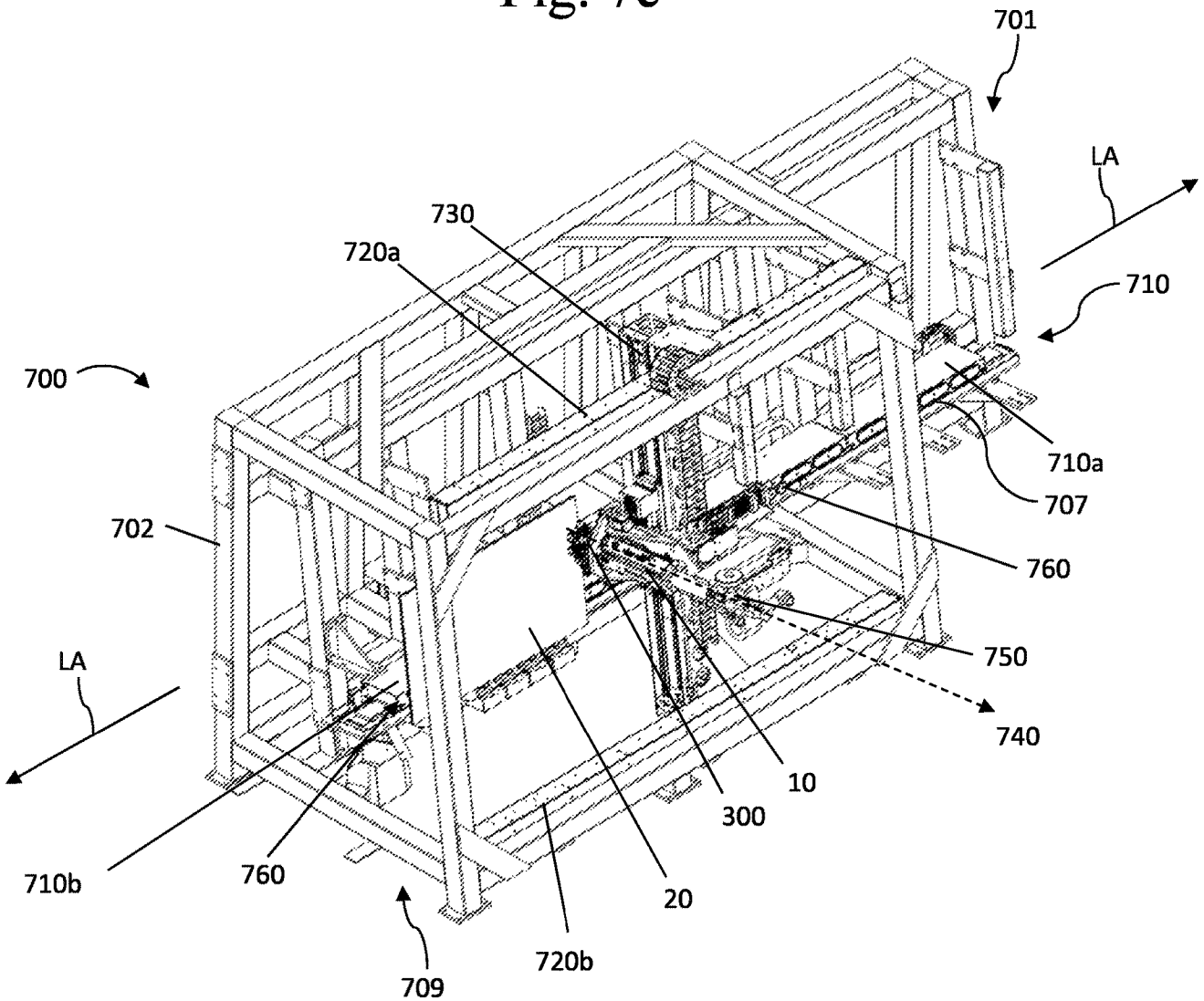
FIG. 7*c* is a perspective view of the sealant applicator station of FIG. 7*a*, shown with an IG unit on the station and a sealant applicator head delivering sealant onto a second side of the IG unit.
Figure 7D:
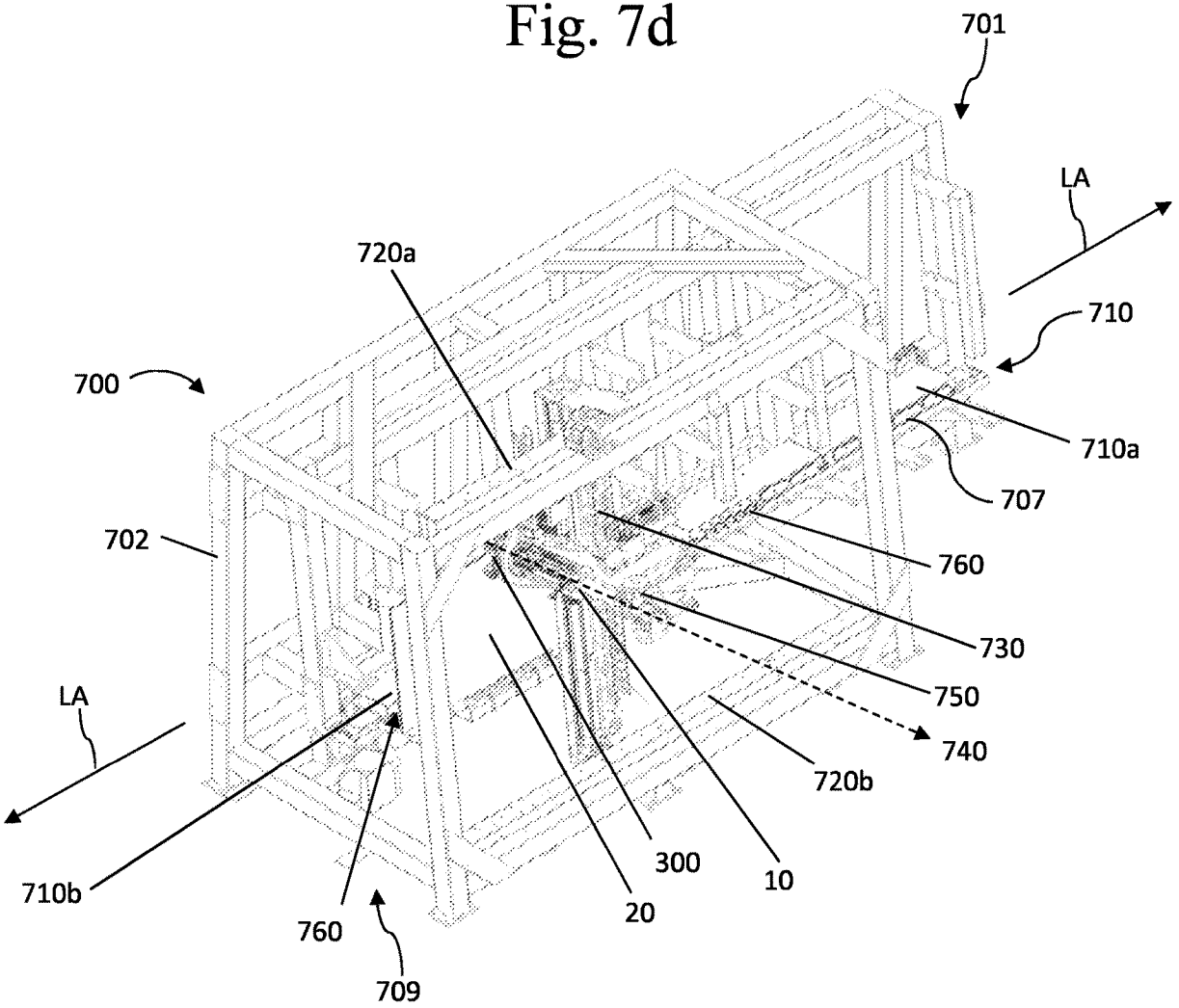
FIG. 7*d* is a perspective view of the sealant applicator station of FIG. 7*a*, shown with an IG unit on the station and a sealant applicator head delivering sealant onto a third side of the IG unit.
Figure 7E:
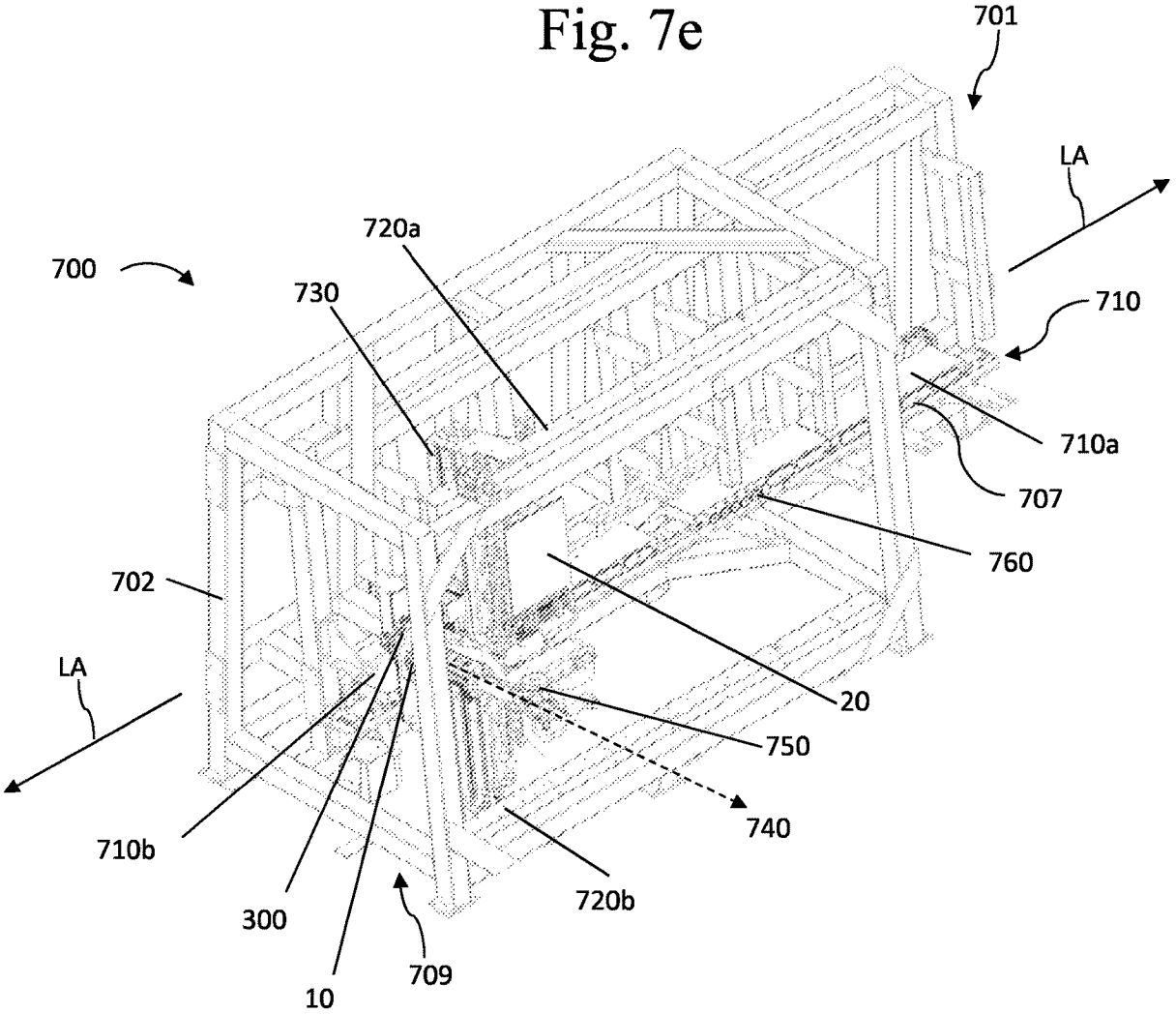
FIG. 7*e* is a perspective view of the sealant applicator station of FIG. 7*a*, shown with an IG unit on the station and a sealant applicator head delivering sealant onto a fourth side of the IG unit.

In connection with actually applying the sealant to the IG unit 20, the sealant applicator machine 10 preferably is moveable horizontally and substantially vertically. In FIGS. 7*a*-7*b*, the frame 702 includes an upright beam (e.g., substantially vertical beam) 730 and two horizontal beams 720*a*, 720. The illustrated sealant applicator machine 10 is mounted to move (e.g., substantially vertically) along the upright beam 730, and the upright beam is mounted to move horizontally along the two horizontal beams 720*a*, 720*b*. This allows the sealant applicator machine 10 to move, relative to the IG unit 20, to different elevations (e.g., substantially vertically), horizontally, or both. It is to be understood that "substantially vertically, "substantially vertical," and the like also include true vertical. Another option is to have the sealant applicator machine mounted to move horizontally along a horizontal beam, while the horizontal beam is mounted to move vertically along two vertical beams.

In FIGS. 7*a*-7*e*, upright beam 730 is perpendicular to horizontal beams 720*a*, 720*b*. Thus, upright beam 730 defines a Y axis of the station 700, and each of the horizontal beams 720*a*, 720*b* defines an X axis of the station. The Z axis of the station 700, which is perpendicular to the X and Y axes, is shown by reference number 740 in FIGS. 7*b*-7*e*.

In FIGS. 7*a*-7*e*, the station 700 has one or more motors configured to move the sealant applicator machine 10 along the Y axis (e.g., along upright beam 730), as well as one or more motors configured to move the sealant applicator machine 10 along the X axis (e.g., by moving upright beam 730 along horizontal beams 720*a*, 720*b*). In addition, the sealant applicator machine 10 preferably has one or more motors configured to move the adjustable sealant-dispensing head 100 along the Z axis and to subsequently rotate the adjustable sealant-dispensing head about the Z axis. For example, upon moving an IG unit 20 to the working position of the station 700, the desired sealant applicator head (100 or 200) is moved along the Z axis generally toward the IG unit until the desired head is adjacent to (and may project into) a first side of the perimeter of the IG unit. The sealant applicator machine 10 is then moved along the first side of the perimeter of the IG unit while the desired (or "active") head dispenses sealant along the first side. Upon reaching a corner, the active head is rotated so as to turn the corner and thereafter be oriented to dispense sealant as the head subsequently moves along the second side. This sequence of steps is repeated for each side of the IG unit, e.g., until the desired sealant arrangement has been applied about the entire perimeter of the IG unit.

In one non-limiting example, the sealant applicator station is controlled using an industrial controller with integrated motion controller for controlling servo motor position, speed, and torque. The sealant applicator station also has a HMI for machine control functions as starting the sealant applicator, monitoring IGU data, and status information regarding the sealant applicator and the IGU being processed. The HMI also provides visual aids, explanations, and remedies when faults occur during operation. Servo motors are used on the servo conveyors for IGU transport, Cartesian style gantry with X, Y, Z and R servo axis for controlling the sealant applicator machine motion, and servo inlet and outlet carriage axis for controlling the conveyance IGU into and out of the sealant applicator machine. Servo conveyor positions IGU at the loading of the inlet carriage. Additional four servos control silicone metering and nozzle size adjustment. An Ethernet based pneumatic valve with integrated electronic input and outputs (I/O) is used to control actuations on the sealant applicator head and monitor actuations as in feedback from pneumatic actuators. Also, the silicone pressure at the head is monitored, using a pressure transducer on the silicone conduit and controlled to set pressure using an air over silicone pressure regulator with electronic air regulator, controlled via the pneumatic valve with integrated input and output, supplying air pressure to the silicone regulator. A second and third pneumatic valve banks with electronic I/O is used for vacuum cup functions on the inlet and outlet carriages. Pneumatic valves with electronic I/O are connected to the PLC controller via a machine network, which enables the direct control and monitoring of valves and I/O from the PLC. The sealant applicator station 700 can operate in two modes, MTO (made to order) and MTS (made to stock). In MTO mode, a barcode reader is used to obtain IGU barcode number and the PLC communicates this number with production database to obtain manufacturing information regarding IGU loaded into the station, unit length, height and thickness, seal type etc. In MTO mode, the information regarding the IGU is manually entered into the HMI. Once the IGU is processed, it is transported from the station to allow the next IGU to enter the station.

While an illustrative embodiment of the present invention has been described, it should be understood that various changes, adaptations, combinations of features and modifications may be made therein without departing from the spirit of the invention and the scope of the appended claims.

The invention claimed is:

1. A sealant applicator machine for dispensing sealant onto an insulating glazing unit that includes two panes separated by a spacer having a spacer width, the sealant applicator machine comprising:

an adjustable sealant-dispensing head comprising:

an inner nozzle portion having a first dispensing orifice;

an outer nozzle portion having a second dispensing orifice;

the inner and outer nozzle portions being moveable selectively toward or away from each other such that a gap distance between the inner nozzle portion and the outer nozzle portion is adjustable;

a fixed width dispensing orifice, the inner and outer nozzle portions being moveable, selectively toward or away from each other, relative to the fixed width dispensing orifice;

one or more sealant supplies operably coupled with the first and second dispensing orifices.

2. The sealant applicator machine of claim 1, wherein the adjustable sealant-dispensing head further comprises a guide located between the inner nozzle portion and the outer nozzle portion, wherein the guide comprises a plate having opposed first and second wall surfaces and an end surface extending from the first wall surface to the second wall surface, the end surface configured to move along a perimeter channel of the insulating glazing unit during movement of the adjustable sealant-dispensing head along a perimeter of the insulating glazing unit.

3. The sealant applicator machine of claim 1, wherein the inner nozzle portion comprises a third dispensing orifice located in a fixed relationship to the first dispensing orifice, and the outer nozzle portion comprises a fourth dispensing orifice located in a fixed relationship to the second dispensing orifice, the one or more sealant supplies operably coupled with the third and fourth dispensing orifices.

4. The sealant applicator machine of claim 3, wherein the inner nozzle portion comprises a single integral body that defines both the first and third dispensing orifices, and the outer nozzle portion comprises a single integral body that defines both the second and fourth dispensing orifices.

5. The sealant applicator machine of claim 1, wherein the adjustable sealant-dispensing head is adjustable to dispense sealant arrangements of different widths.

6. The sealant applicator machine of claim 5, further comprising a fixed width sealant-dispensing head, wherein the fixed width sealant-dispensing head is not adjustable but rather is adapted to dispense sealant arrangements of a single width, and wherein either of the fixed width sealant-dispensing head and the adjustable sealant-dispensing head can be actuated selectively to move around a perimeter of the insulating glazing unit while dispensing sealant onto the insulating glazing unit.

7. The sealant applicator machine of claim 5, wherein the adjustable sealant-dispensing head can be adjusted, without conducting any disassembly of the sealant applicator machine, to dispense sealant arrangements of different widths.

8. The sealant applicator machine of claim 1, wherein the fixed width dispensing orifice is configured to dispense a sheet of sealant that spans at least 50% of the pane separation distance.

9. A method of dispensing sealant onto a first insulating glazing unit that includes two panes separated by a spacer having a first spacer width, the method comprising:

providing a sealant applicator machine, the machine comprising:

an adjustable sealant-dispensing head comprising:

an inner nozzle portion having a first dispensing orifice;

an outer nozzle portion having a second dispensing orifice;

a fixed width dispensing orifice;

one or more sealant metering devices operably coupled with the first and second dispensing orifices;

determining a desired pane separation distance for the two panes of the first insulating glazing unit;

adjusting a gap distance between the inner nozzle portion and the outer nozzle portion based on the desired pane separation distance for the first insulating glazing unit;

said adjustment of the gap distance being performed by moving both the inner nozzle portion and the outer nozzle portion, relative to the fixed width dispensing orifice toward or away from each other;

and operating the one or more sealant metering devices such that the first and second dispensing orifices dispense sealant onto the first insulating glazing unit said operating the one or more sealant metering devices further comprising dispensing sealant from the fixed width dispensing orifice onto the insulating glazing unit.

10. The method of claim 9, wherein the adjustable sealant-dispensing head further comprises a guide located between the inner nozzle portion and the outer nozzle portion, the method comprising moving the adjustable sealant-dispensing head around a perimeter of the insulating glazing unit such that, during this movement, the guide is a leading portion of the adjustable sealant-dispensing head while the inner and outer nozzle portions are trailing portions of the adjustable sealant-dispensing head.

11. The method of claim 9, wherein the adjustable sealant-dispensing head further comprises a third dispensing orifice positioned on the inner nozzle portion and a fourth dispensing orifice positioned on the outer nozzle portion, and wherein said dispensing of sealant further comprises dispensing sealant from the third and fourth dispensing orifices onto the insulating glazing unit.

12. The method of claim 11, wherein said dispensing of sealant comprises (i) dispensing two first beads of sealant from the first and second dispensing orifices onto the insulating glazing unit, (ii) dispensing two second beads from the third and fourth dispensing orifices onto the insulating glazing unit, and (iii) dispensing a third seal from the fixed width dispensing orifice onto the insulating glazing unit, such that the resulting sealant arrangement comprises five sealant deposits.

13. The method of claim 12, wherein each of the five sealant deposits contacts one or two of the other four sealant deposits, such that all five sealant deposits form a single, continuous blanket of sealant covering an outside face of the spacer.

14. The method of claim 9, further comprising dispensing sealant onto a second insulating glazing unit that has two panes separated by a spacer having a second spacer width, the first and second spacer widths being different, the sealant applicator machine further comprising a fixed width sealant-dispensing head, the fixed width sealant-dispensing head being operable independent of the adjustable sealant-dispensing head, the fixed width sealant-dispensing head comprising a plurality of fixed dispensing orifices, the method comprising aligning the fixed width sealant-dispensing head with the second insulating glazing unit, and dispensing sealant from the fixed width sealant-dispensing head onto the second insulating glazing unit while maintaining the plurality of fixed dispensing orifices in fixed positions relative to one another.

15. The method of claim 14 wherein the fixed width sealant-dispensing head comprises three fixed dispensing orifices including spaced-apart first and second bead orifices and a skim orifice, the skim orifice being spaced apart from the first and second bead orifices.

16. The method of claim 14, wherein the adjustable sealant-dispensing head is adjustable to dispense sealant arrangements of different widths, while the fixed width sealant-dispensing head is not adjustable but rather is constructed to dispense sealant arrangements of a single width, and wherein either of the fixed width sealant-dispensing head and the adjustable sealant-dispensing head can be actuated selectively to move around a perimeter of a desired insulating glazing unit while dispensing sealant onto the desired insulating glazing unit.

17. The method of claim 9, further comprising dispensing sealant onto a second insulating glazing unit that has two panes separated by a spacer having a second spacer width, the first and second spacer widths being different, the method comprising operating the adjustable sealant-dispensing head to dispense a first sealant arrangement onto the first insulating glazing unit, then adjusting the gap distance between the inner and outer nozzle portions, and thereafter operating the adjustable sealant-dispensing head to dispense a second sealant arrangement onto the second insulating glazing unit, the first and second sealant arrangements having different widths, the first and second sealant arrangements having widths that differ by at least 2 mm.

18. The method of claim 9, wherein the first insulating glazing unit is held stationary as the sealant applicator machine moves into engagement with the first insulating glazing unit and then around a perimeter of the first insulating glazing unit, said movement of the sealant applicator machine around the perimeter of the first insulating glazing unit comprising moving the adjustable sealant-dispensing head entirely about the perimeter of the first insulating glazing unit so as to apply sealant onto all edges of the first insulating glazing unit.

19. The method of claim 9, wherein the method produces a sealant arrangement comprising multiple sealant deposits, the sealant arrangement comprising first and second beads that adhere respectively to the two panes, the first and second beads dispensed from the first and second dispensing orifices, the sealant arrangement further comprising a third seal that defines a central span of the sealant arrangement and does not contact the two panes, the third seal dispensed from the fixed width dispensing orifice.

20. The method of claim 9, wherein the method produces a sealant arrangement comprising multiple sealant deposits, the sealant arrangement extending continuously from an inner surface of a first of the two panes to an inner surface of a second of the two panes, such that the sealant arrangement entirely covers an outside face of the spacer.

21. The method of claim 9, wherein the method comprises positioning the adjustable sealant-dispensing head relative to the first insulating glazing unit such that the adjustable sealant-dispensing head projects into a perimeter channel of the first insulating glazing unit.

22. A sealant applicator station comprising a frame, a sealant applicator machine, and a substrate transport system, the frame comprising a plurality of beams, the sealant applicator machine comprising an adjustable sealant-dispensing head and a supply of sealant, the adjustable sealant-dispensing head comprising: i) an inner nozzle portion having a first dispensing orifice, and ii) an outer nozzle portion having a second dispensing orifice, and iii) a fixed width dispensing orifice; the inner and outer nozzle portions being moveable relative to the fixed width dispensing orifice, selectively toward or away from each other so as to change a gap distance between the inner nozzle portion and the outer nozzle portion and thereby change a width of a sealant arrangement that the adjustable sealant-dispensing head is configured to dispense, the substrate transport system comprising a conveyor elongated along a lateral axis of the sealant applicator station.

23. The sealant applicator station of claim 22 wherein the frame includes an upright beam and two horizontal beams, the sealant applicator machine being mounted to move along the upright beam, and the upright beam being mounted to move horizontally along the two horizontal beams.

24. The sealant applicator station of claim 23 wherein the upright beam defines a Y axis of the sealant applicator station, each of the two horizontal beams defines an X axis of the sealant applicator station, and the sealant applicator station has a Z axis that is perpendicular to the X and Y axes, the sealant applicator machine having one or more motors configured to move the adjustable sealant-dispensing head along the Z axis and to subsequently rotate the adjustable sealant-dispensing head about the Z axis.

25. The sealant applicator station of claim 22 wherein the sealant applicator machine further comprises a fixed width sealant-dispensing head, the fixed width sealant-dispensing head having a fixed width dispensing nozzle that is constructed to dispense sealant arrangements of only a single width.

26. The sealant applicator station of claim 22 wherein the substrate transport system further comprises an inlet carriage and an outlet carriage, the inlet carriage mounted to move along a first rail that is elongated along the lateral axis of the sealant applicator station, the outlet carriage mounted to move along a second rail that is elongated along the lateral axis of the sealant applicator station, the inlet carriage and the outlet carriage each having one or more suction cups, the first rail extending from the conveyor to a working position of the sealant applicator station, the second rail extending from the working position of the sealant applicator station to a downstream position.

27. The sealant applicator station of claim 22 wherein the conveyor has a downstream end region that is positioned adjacent to an upstream end region of the first rail such that when the conveyor moves an IG unit to the downstream end region of the conveyor, one or more suction cups on the inlet carriage can be activated and thereby secured to the IG unit, at which point the inlet carriage, while carrying the IG unit, can move downstream along the first rail until the IG unit reaches the working position, at which point one or more suction cups on the outlet carriage can be activated and thereby secured to the IG unit after which the one or more suction cups on the inlet carriage can be deactivated and thereby released from the IG unit, and wherein subsequently the outlet carriage, while carrying the IG unit, can move along the second rail to the downstream position.

28. The sealant applicator station of claim 22, wherein the inner nozzle portion comprises a third dispensing orifice located in a fixed relationship to the first dispensing orifice, and the outer nozzle portion comprises a fourth dispensing orifice located in a fixed relationship to the second dispensing orifice, the inner nozzle portion comprising a single integral body that defines both the first and third dispensing orifices, the outer nozzle portion comprising a single integral body that defines both the second and fourth dispensing orifices.

29. The sealant applicator station of claim 22, wherein the adjustable sealant-dispensing head can be adjusted, without conducting any disassembly of the sealant applicator machine, to dispense sealant arrangements of different widths.

30. The sealant applicator station of claim 22, wherein the fixed width dispensing orifice is configured to dispense a sheet of sealant that spans at least 50% of the pane separation distance.

* * * * *